US008867749B2

(12) United States Patent
McGowan

(10) Patent No.: US 8,867,749 B2
(45) Date of Patent: Oct. 21, 2014

(54) ACOUSTIC SPATIAL PROJECTOR

(75) Inventor: Paul Blair McGowan, Boulder, CO (US)

(73) Assignee: Paul Blair McGowan, Boulder, CO (US)

( * ) Notice: Subject to any disclaimer, the term of this patent is extended or adjusted under 35 U.S.C. 154(b) by 552 days.

(21) Appl. No.: 13/089,020

(22) Filed: Apr. 18, 2011

(65) Prior Publication Data

US 2012/0263306 A1 Oct. 18, 2012

(51) Int. Cl.
*H04R 5/00* (2006.01)
*H04R 5/02* (2006.01)

(52) U.S. Cl.
CPC ..... *H04R 5/00* (2013.01)
USPC ..... 381/17; 381/300

(58) Field of Classification Search
USPC ..... 381/17, 300, 63, 71.1–71.4, 79, 160, 381/97, 119, 352, 307, 335; 181/155, 156
See application file for complete search history.

(56) References Cited

U.S. PATENT DOCUMENTS

| | | | |
|---|---|---|---|
| 2,979,149 | A | 9/1954 | Carlsson |
| 3,582,553 | A | 6/1971 | Bose |
| 3,759,345 | A | 9/1973 | Borisenko |
| 4,058,675 | A | 11/1977 | Kobayashi |
| 4,133,975 | A | 1/1979 | Barker, III |
| 4,218,583 | A | 8/1980 | Poulo |
| 4,218,585 | A | 8/1980 | Carver |
| 4,256,922 | A | 3/1981 | Gorike |
| 4,356,349 | A | 10/1982 | Robinson |
| 4,418,243 | A | 11/1983 | Fixler |
| 4,475,620 | A | 10/1984 | Carlsson |
| 4,503,930 | A | 3/1985 | McDowell |
| 4,569,074 | A | 2/1986 | Polk |
| 4,596,034 | A | 6/1986 | Moncrieff |
| 4,748,669 | A | 5/1988 | Klayman |
| 4,841,572 | A | 6/1989 | Klayman |
| 4,847,904 | A | 7/1989 | McShane |
| 4,866,774 | A | 9/1989 | Klayman |

(Continued)

FOREIGN PATENT DOCUMENTS

EP 0025118 A1 3/1981

OTHER PUBLICATIONS

The Mirage Uni—Theater Owners Manual; 24 pages.

(Continued)

*Primary Examiner* — Vivian Chin
*Assistant Examiner* — Ammar Hamid
(74) *Attorney, Agent, or Firm* — Shook, Hardy & Bacon, LLP.

(57) ABSTRACT

A method and system for producing an acoustic spatial projection by creating audio channels for producing an acoustic field by mixing, on a reflective surface, sounds associated with the audio channels is provided. In one embodiment, a method includes the step of using audio information to determining a set of audio channels. Each audio channel is associated with a sound source, such as one or more loudspeakers, and for a subset of the audio channels, the associated sound sources emit sound waves directed at a reflective surface prior to being received at a listening location. The method further includes steps of determining an acoustic response of a listening environment; steps of determining a delay to apply to one or more channels of the set of audio channels; and steps of determining a frequency compensation to apply to one or more channels of the audio channels.

19 Claims, 18 Drawing Sheets

(56) References Cited

U.S. PATENT DOCUMENTS

| | | | | |
|---|---|---|---|---|
| 5,784,468 | A | 7/1998 | Klayman | |
| 5,870,484 | A | 2/1999 | Greenberger | |
| 6,152,257 | A | 11/2000 | Denham | |
| 6,169,812 | B1 | 1/2001 | Miller | |
| 6,577,738 | B2 | 6/2003 | Norris et al. | |
| 6,633,648 | B1 | 10/2003 | Bauck | |
| 6,725,967 | B2 | 4/2004 | Hlibowicki | |
| 6,996,243 | B2 | 2/2006 | Welker et al. | |
| 8,041,061 | B2 * | 10/2011 | Hughes et al. | 381/304 |
| 8,073,156 | B2 * | 12/2011 | Hutt et al. | 381/86 |
| 8,175,285 | B2 * | 5/2012 | Suzuki | 381/61 |
| 2005/0063551 | A1 * | 3/2005 | Cheng et al. | 381/18 |
| 2010/0272270 | A1 * | 10/2010 | Chaikin et al. | 381/59 |
| 2010/0290643 | A1 * | 11/2010 | Mihelich et al. | 381/99 |
| 2010/0310085 | A1 * | 12/2010 | Oh et al. | 381/71.11 |
| 2012/0121092 | A1 * | 5/2012 | Starobin | 381/17 |

OTHER PUBLICATIONS

Klopsch Group, Inc.; Mirage Speakers Design Philosophy; http://www.miragespeakers.com/na-en/about/philosophy; May 16, 2011; 2 pages.

Bose Direct/Reflecting Speaker Technology; http://www.bose.com/controller?url=/popup/tech_details/pop_dr_technology.jsp; May 16, 2011.

* cited by examiner

PROJECTOR MOUNTED IN DASHBOARD
REFLECTING OFF FRONT (OR REAR) WINDSHIELD

ACOUSTIC SPATIAL PROJECTOR

CROSS-REFERENCE TO RELATED APPLICATIONS

Not applicable.

STATEMENT REGARDING FEDERALLY SPONSORED RESEARCH OR DEVELOPMENT

Not applicable.

SUMMARY

Embodiments of our technology are defined by the claims below, not this summary. A high-level overview of various aspects of our technology are provided here for that reason, to provide an overview of the disclosure, and to introduce a selection of concepts that are further described below in the detailed-description section. This summary is not intended to identify key features or essential features of the claimed subject matter, nor is it intended to be used as an aid in isolation to determine the scope of the claimed subject matter. In brief and at a high level, this disclosure describes, among other things, ways to provide a listener with an enhanced listening experience, which enables the listener to more accurately perceive directional-audio information from almost any position within a listening area.

In brief, embodiments of the technologies described herein provide ways to facilitate the creation of an acoustic field, which provides the enhanced listening experience, by utilizing an acoustically-reflective surface to mix sounds associated with channels of audio information and project the resulting mixed-sounds into a listening area. In one embodiment, audio channels are created for producing an acoustic field, which is produced by mixing sounds associated with the audio channels on a reflective surface. For example, the reflective surface might be a wall or walls in a room, a windshield in a vehicle, or any surface or set of surfaces that reflect acoustic waves. The sounds associated with the audio channels are generated by sound sources, with each sound source associated with an audio channel. Each sound source may be comprised of one or more electro-acoustic transducers such as loud speakers or other sound-generating devices. Thus for example, a single sound source may comprise a tweeter and a midrange speaker. The audio channels are created by processing audio information, which is received from an audio-information source such as, for example, a CD player, tuner, television, theater, microphone, DVD player, digital music player, tape machine, record-player, or any similar source of audio information. The audio information may be processed, along with other information about the environment of the listening area, to create three audio channels: a Left-Back channel, a Center-Back channel, and a Right-Back channel. Each of the three channels is associated with a sound source that is directionally positioned with respect to the other sound sources and the reflecting surface(s) so as to direct sound onto the surface where it can acoustically mix with sounds from the other sound sources and reflect as a coherent wave launch into a listening area. A listening area might include the passenger area of a car, the seating area in a movie theatre or home theatre, or a substantial portion of the floor space in a room used by a listener to listen to music or sounds corresponding to the audio information, for example. The wave launch may include three-dimensional cues, which enable a listener to more accurately perceive directional-audio information, such as point sources of sound, from almost any position within a listening area. For example, if a listener were listening to a recording of an orchestra that featured a trumpet solo, the listener would be able to perceive the location, in three-dimensional space, of the trumpet as though the listener were actually in the presence of the orchestra.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1A:
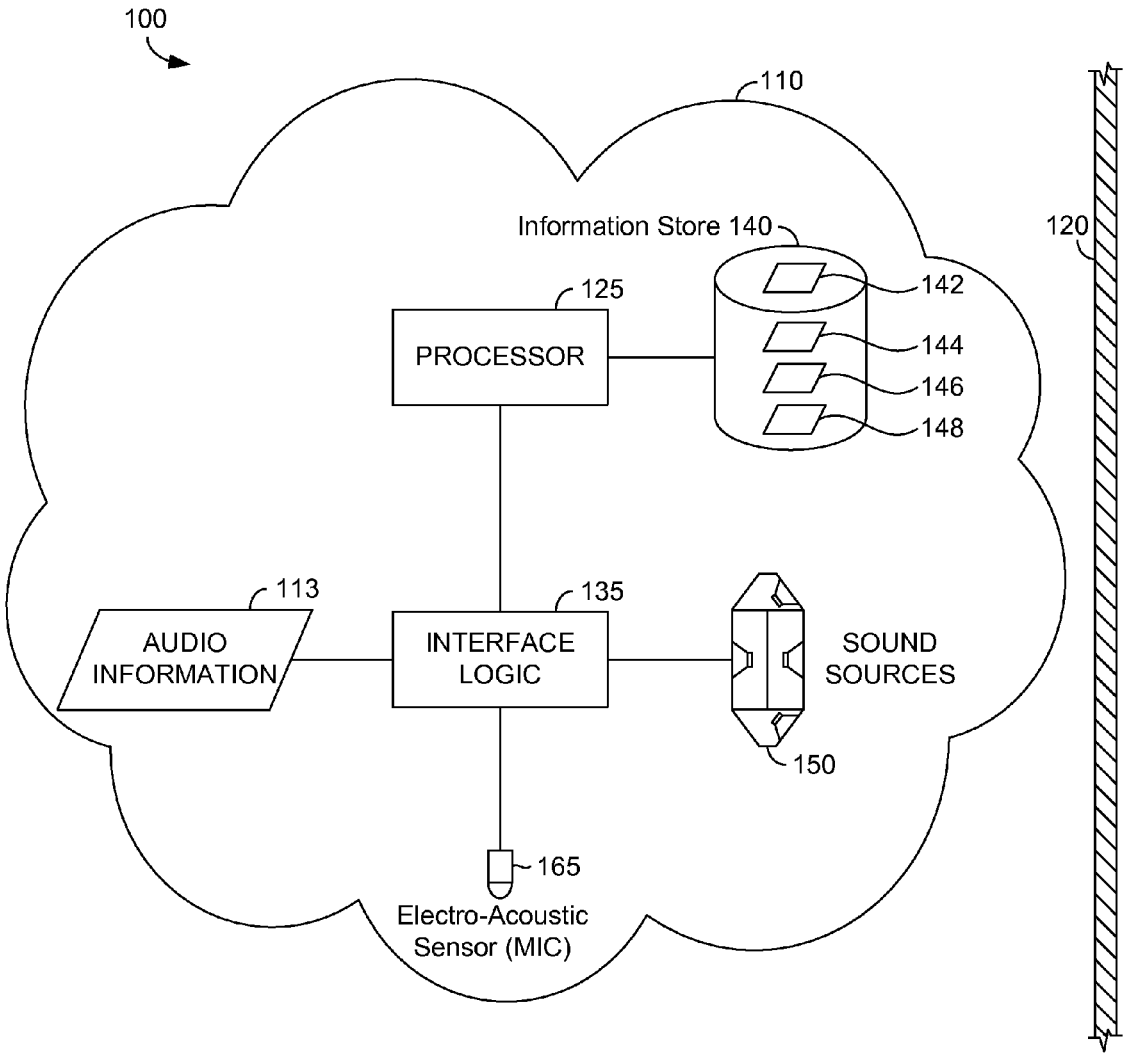
FIGS. 1A and 1B depict aspects of an illustrative operating environment suitable for practicing an embodiment of our technology.

The subject matter of the present technology is described with specificity herein to meet statutory requirements. However, the description itself is not intended to define the technology, which is what the claims do. Rather, the claimed subject matter might be embodied in other ways to include different steps or combinations of steps similar to the ones described in this document, in conjunction with other present or future technologies. Moreover, although the term "step" or other generic term might be used herein to connote different components or methods employed, the terms should not be interpreted as implying any particular order among or between various steps herein disclosed unless and except when the order of individual steps is explicitly described.

ACRONYMS AND SHORTHAND NOTATIONS

Throughout the description of the present invention, several acronyms and shorthand notations are used to aid the understanding of certain concepts pertaining to the associated system and services. These acronyms, and shorthand notations are solely intended for the purpose of providing an easy methodology of communicating the ideas expressed herein and are in no way meant to limit the scope of the present invention. The following is a list of these acronyms:

ASP Acoustic Spatial Projector

RST Reflective Surface Transducer

Further, various technical terms are used throughout this description.

As one skilled in the art will appreciate, embodiments of our technology may be embodied as, among other things: a method, system, or set of instructions embodied on one or more computer-readable media. Accordingly, the embodiments may take the form of a hardware embodiment, a software embodiment, or an embodiment combining software and hardware. In one embodiment, the present invention takes the form of a computer-program product that includes computer-useable instructions embodied on one or more computer-readable media.

Computer-readable media include both volatile and nonvolatile media, removable and nonremovable media, and contemplates media readable by a database, a switch, and various other network devices. By way of example, and not limitation, computer-readable media comprise media implemented in any method or technology for storing information. Examples of stored information include computer-useable instructions, data structures, program modules, and other data representations. Media examples include, but are not limited to information-delivery media, RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data momentarily, temporarily, or permanently.

Illustrative uses of our technology, as will be greatly expanded upon below, might be, for example, to provide a more realistic listening experience to listeners of recorded or reproduced music or sounds listening in the home, car, or at work; at a movie theater, amusement-park ride; exhibit, auditorium; showroom; or advertisement.

By way of background, stereophonic recordings rely for their dimensional content on the spacing of left and right microphones, or as directed by a recording engineer, a mimic of a stereo arrangement of microphones. Phase, time, and amplitude differences between what is recorded or transmitted on the left versus the right audio component enable the ear-brain mechanism to be persuaded that a sound event has spatial reality in spite of the listening area contribution. In other words, verbatim physical reality is not required for the ear-brain combination to selectively ignore phase, time, and amplitude information contributed from the real listening area and perceive the event with whatever spatial signature is in the program material.

However, for the listener's mind to be convinced that it is receiving a stereophonic image, audio reproduction of the left and right channel information must reach the listener's left and right ears independently and in a coherent time sequence. The term "coherent" is used herein in the sense that the coherent part of a sound field is that part of a wave velocity potential which is equivalent to that generated by a simple or point source in free space conditions, i.e., is associated with a definite direction of sound energy flow or ordered wave motion. Thus, "incoherent" sound includes those other components constituting the velocity potential of a sound field in a room that are associated with no one definite direction of sound energy flow. Two principal elements in lateral localization of sound are time (phase) and intensity. A louder sound seems closer, and a sound arriving later in time seems further away. The listener will employ both ears and the perceptive interval between the two ears to establish lateral localization. This is known as the Pinnar effect, which is often discussed in terms of interaural crosstalk.

Many loudspeaker design efforts are directed at providing the most uniform total radiated power response, in a standard two-channel stereo manner, rather than attempting to address problems of stereo dimensionality. While achieving uniform radiated power response may in some instances ensure that the perceived output may have accurate instrumental timbre, it may not insure that the listener will hear a dimensionally convincing version of the original sound from a wide range of positions in typical listening environments; in fact, quite the opposite.

In many stereophonic reproduction devices, the respective stereo signals are typically reproduced by systems, hereinafter referred to as stereo loudspeaker systems, that use two loudspeakers, mounted in a spatially fixed relation to one another. In such arrangements, a listener with normal hearing is positioned in front of and equidistant from equivolume radiating speakers of a pair of such loudspeaker systems, with the right and left loudspeaker systems respectively reproducing the right and left stereo channels monophonically. In these arrangements, the listener will perceive equal-sound amplitude, early-arrival components along with room reflected ambient versions of the sound arriving later in time. Independent left ear and right ear perception may be compromised by some left ear perception of the right channel around the head dimension, and vice versa. The perception of these interaural effects is in the early arrival time domain so that the later arrival room reflections do not ameliorate the diminished perceptions of the left and right difference component. As the listener moves into position closer to, for example, the left loudspeaker system than the other, the effect worsens. The output from the right and thus more distant loudspeaker appears reduced until sound from only the nearer left loudspeaker system envelopes the listener. Since the stereophonic effect of two sets of microphones with finite physical spacing depends on the listener's perception of the difference between channels, the reduction to the left channel (or right) destroys the already interaurally compromised left-right signal. This is known as the Proximity Problem.

Embodiments of our technology provide a number of advantages over stereophonic sound produced by stereo loudspeaker systems including reducing, and in some embodiments eliminating, interaural crosstalk, providing a wider and deeper sweet spot thereby reducing the need for specific listener placement and reducing the proximity problem, and providing more accurate three-dimensional acoustic cues that enable a listener to better perceive directional audio information. Additional benefits include overcoming negative acoustic effects of the listening environment or using the acoustic qualities of the listening environment to the advantage, rather than disadvantage, as in traditional stereo technologies, of producing a three-dimensional acoustic field.

Furthermore, our technology can be implemented as a single acoustic spatial projector (ASP) for stereo or monophonic audio reproduction, which in one embodiment comprises a computing device and a loud-speaker enclosure, or implemented in a multi-channel surround sound configuration by utilizing a surround sound decoder, which in one embodiment is performed by the computing device, and two or more acoustic spatial projectors, one in front of the listener and the second behind the listener, with both ASPs operating on the same principal audio information but receiving different audio signals from the surround decoder. These examples illustrate only various aspects of using our technology and are not intended to define or limit our technology.

The claims are drawn to systems, methods, and instructions embodied on computer readable media for facilitating a method of ultimately producing a three-dimensional acoustic field by mixing sounds associated with audio channels on a reflective surface. In some embodiments, each audio channel is associated with a sound source that is directionally positioned with respect to the other sound sources and a reflecting surface or surfaces so as to direct sound onto the surface where it can acoustically mix with sounds from the other sound sources and reflect as a coherent wave launch into a listening area. Some embodiments of the present invention comprise a single loud-speaker enclosure having a computing device for receiving and processing audio information and information about the listening environment to create audio channels, and a sound source associated with each created audio channel, that is directionally positioned to facilitate the mixing of sounds on a reflective surface or set of surfaces. In embodiments, the reflective surface(s) functions as a component, which we refer to as a Reflective Surface Transducer (RST), of the sound system by facilitating the summation of component sounds from each sound source that is associated with each audio channel, and serving as a primary projection point of the acoustic image into the listening area. In one embodiment, the audio channels comprise combinations of the component signals and difference signals corresponding to the received audio information.

Some embodiments further process the audio channels to compensate for environmental factors of the listening area such as the acoustic reflectivity qualities of the reflective surface, the distance between the sound sources and the reflective surface, and the size of the room, for example. In one embodiment, an electronic compensation system is employed, which comprises a microphone for receiving acoustic response information from the listening-area environment and instructions for modifying the audio channels, based on the received acoustic response information and a model acoustic response. In one embodiment, the audio channels are further processed using an amplitude-variable image widening image algorithm. In one embodiment, a derived (or direct) and time-compensated center channel, directionally positioned to substantially face the listening area, is provided to solidify the acoustic field produced by the RST.

In embodiments having a single enclosure, the enclosure can take multiple forms including a freestanding floor embodiment, a freestanding tabletop embodiment, an on-wall (or ceiling) installed embodiment, and an in-wall (or ceiling) installed embodiment. In one embodiment, the enclosure includes three rear-facing sets of full range sound sources, which comprise an acoustic spatial projector (ASP), with each sound source comprised of one or more electro-acoustic transducers. In one embodiment the enclosure further includes a front-facing full range sound source. The three rear-facing sound sources, which comprise the ASP, are rear facing, with respect to the listening area, and are directionally positioned at angles to each other, based in part on their distance from a reflecting surface. In one embodiment, a center-back sound source is positioned to directly face the reflective surface, a left-back sound source is directionally positioned to face X-degrees left of the center-back sound source, and a right-back sound source is directionally positioned to face X-degrees to the right of the center-back source, where X is determined based, at least in part, on the distance between the sound sources and the reflective surface. In one embodiment, X is also based on the listening area environment. In one embodiment, X is based on user-preferences. In one embodiment, X is 30-degrees, and in another embodiment, X is adjustable. In one embodiment a computing device may control a motor to automatically position the left-back and right-back sound sources at an angle of X-degrees. In one embodiment, a front-facing sound source, also referred to as the center-front sound source, is directionally positioned to face the listening area.

In some embodiments, audio channels associated with the center-front and center-back sound sources are delayed in time based, at least in part, on the duration of time necessary for sound waves emitted by the sound sources to reach a listening location within the listening area. For example, in one embodiment the audio channels associated with the center-back and center-front sound sources delayed by different amounts of time such that sound waves emitted from each of the left-back, center-back, right-back, and center-front, sound sources reach a location at nearly the same moment in time. In one embodiment, this delay varies between 10 ms and 30 ms and in one embodiment is user configurable. In one embodiment the audio channel associated with either the left-back or right-back sound source is also delayed such that sound waves emitted from each of the sound sources reach a location at nearly the same moment in time. Such a configuration may be desirable where the position of the ASP enclosure is not centered horizontally with respect to the reflecting surface, and thus sound waves reflecting to one side (left or right) would need to travel a greater distance to reflect and come back to a location in the listening area than sound waves reflecting in the other direction. In one embodiment, a delay is determined such that sound waves emitted from at least one sound source reach a listening location in the listening area at a different moment in time than another sound source.

At a high level in one embodiment, a method is provided for creating audio channels for producing an acoustic field by mixing sounds from sound sources associated with the audio channels on an acoustically-reflective surface and projecting the resulting mixed sounds into a listening area. The method starts with receiving audio information. The audio information may be received from an audio information source such as, for example, a digital music player. Based on the received audio information, a set of audio channels is determined comprising a left-back channel, a center-back channel, and a right-back channel. In one embodiment, a center-front channel is also determined in the set of audio channels. Next a delay is determined and applied to one of the audio channels, based on an estimated duration of time necessary for sound waves, emitted from a sound source associated with another audio channel, to reach a listening location in a listening area. In one embodiment, a delay is determined and applied to the center-back audio channel so that sound waves emitted from a sound source associated with the center-back channel reach a location at a certain time with respect to sound waves emitted from sound sources associated with the left-back and right-back audio channels. For example, in one embodiment, the delay may be determined such that the sound waves emitted from the sound source associated with the center-back channel reach the listening location at the same time as sound waves emitted from sound sources associated with the left-back and right-back audio channels. In one embodiment a second delay is also determined and applied to the center-front channel so that sound waves emitted from a sound source associated with the center-front channel reach a location within a certain time with respect to sound waves emitted from sound sources associated with the other channels.

Next a frequency compensation is determined and applied to one of the audio channels in the set of audio channels. The frequency compensation is determined and applied to a range or band of frequencies, which may be narrow or wide, and may also include multiple bands, in one embodiment. The frequency compensation may further include varying the amplitude of certain frequencies or imparting a delay in time of certain frequencies. In one embodiment, the frequency compensation is based on acoustical properties of the listening environment. For example, if the reflective surface is a wall that has curtains covering part of it that would otherwise affect certain frequencies, such as attenuating certain frequencies, then these frequencies can be boosted to compensate. In one embodiment, the frequency compensation is determined based on a model acoustic response such as, for example, the frequency response of an ideal listening environment.

In any closed environment, such as a room, dynamic range reproduction from a sound source, such as one or more loudspeakers, can be restricted and unable to follow exactly the input signal's dynamic range. This is a result of sound pressure confinement that does not match the original space the recording was made in. Thus, a listener within the closed environment will perceive dynamic range restriction, the degree of which varies with the size of the closed environment. For example, if a recording is made in a large hall and then reproduced by a loudspeaker system in a small room (a room that is substantially smaller than the original space it was recorded in), audible dynamic range restriction will occur.

The confinement effect is due to pressurizing the listening environment. A small amount of pressure has little effect in a given space; but as the generated pressure becomes larger, the confinement effect becomes greater. The relationship between the generated pressure, the size of the room, and the resulting compression is due to several factors, including room reflections and an increase in the perceived noise floor of the environment. Some of the factors involve the inverse square law as it applies to waves, as well as the reflected energy and the timing of that reflected energy arriving back at the listener: the smaller the room, the quicker the reflections are returned. Additionally, there is a perception threshold to account for. By way of analogy, imagine, for a moment, ripples in a pond as a result of dropping a pebble into the pond. As the waves (pressure) move away from the stimulus point, they lose energy according to the inverse square law as well as the fact their energy is used to fill an increasingly larger space. Imagine then that the pond is a mile in diameter (analogous to a large room) and now imagine that a 10 foot enclosure is placed at the epicenter of the event (analogous to a small room). The smaller confinement area will see the ripples bouncing off the walls and returning to their source location. If we imagine an observer standing close to the epicenter of the event, in the case of the large diameter pond, the observer will see no restriction from the return energy of the large space. However, in the case of the smaller space, the opposite is true.

Accordingly, to counter this in a dynamic sound system, the source of the energy (a sound source such as a loudspeaker) is made to follow a nonlinear curve such that the output of the sound source gets progressively louder (relative to the input signal) than it is instructed to do so by the input signal. The knee or point of where this nonlinear action is applied depends on the size of the room and the reflective nature of the confined space. The result is that the listener hears little or no dynamic compression. Again consider our analogy of the observer in the pond. In the small space pond scenario, the observer sees the reflected energy from the confinement walls return to the source thereby creating a confusing pattern to the source ripples. But by increasing the amplitude of the source ripples in a dynamic manner (dependent on the amount and timing of the reflected energy) based on a threshold knee that corresponds to the observer's recognition of the return energy, the observer perceptually see a linear movement of the primary ripples. In other words, instead of the primary ripples becoming obviously diffuse due to the reflected energy, the ripples appear to remain articulated in their form, despite the fact that their amplitude is increased.

In the same way, an increase in dynamic range of a sound system, such as a loudspeaker system, can sound uncompressed, if a similar action is applied to the sound system. This can be applied, in one embodiment, by monitoring the volume of the input audio information (e.g., monitoring the amplitude of an input audio signal, such as by using a computing device such as computing device 125 of FIG. 1, for example) and then increasing, in a nonlinear manner, the volume or amplitude of a signal on an audio channel communicatively coupled to an output sound source. In other words, the output volume has a nonlinear relationship to input volume; as the volume of the input-audio information increases, the output sound, which is emitted from a sound source associated with an audio channel that is carrying a signal corresponding to the input-audio information, increases nonlinearly. In one embodiment, for every incremental volume-increase of the input-audio information, the output sound volume increases more so. In one embodiment, as the input volume increases, the output volume increases exponentially. In one embodiment, the increase in output volume follows a polynomial growth rate, based on the input volume level. In one embodiment, the relationship between the output volume and the input volume is linear up to a threshold-volume of the input audio information, and as the volume of the input-audio information increases beyond that threshold, the relationship between the input and output volume becomes nonlinear. In one embodiment, this threshold is dependent on the reflected sound pressure in a listening environment. The threshold may be determined as a function of the received acoustic response information discussed above in connection to FIG. 3. For example, in one embodiment, the size or reflective properties of the listening environment might be determined by measuring the time it takes a sound, such as a "ping" emitted from a sound source to be received by an electro-acoustic sensor. Thus where the listening environment is determined to be a large room, the threshold may be set at point of a higher volume of the input audio information, in one embodiment.

Thus, from a perceptual standpoint, the listener perceives that the dynamic range is linear and uncompressed. But from a measurement standpoint, the dynamic range follows a nonlinear curve with a knee (which corresponds to a threshold-volume, in one embodiment) dependent on the reflected sound pressure within a given room. Further, the knee may move up or down the output amplitude curve depending on room size, in one embodiment.

Figure 1B:
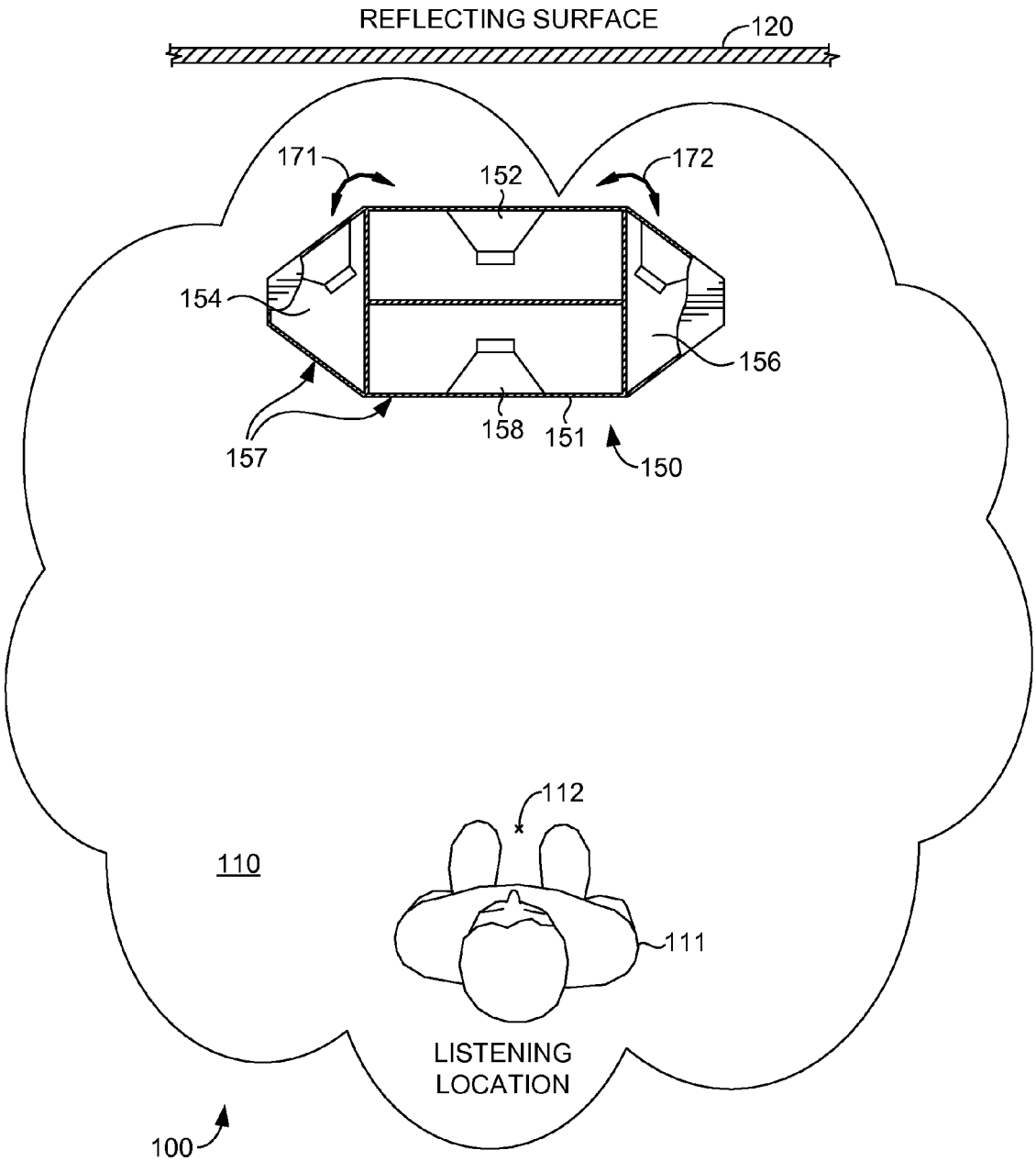

Turning now to FIGS. 1A and 1B, an exemplary operating environment 100 is shown suitable for practicing an embodiment of the invention. We show certain items in block-diagram form more for being able to reference something consistent with the nature of a patent than to imply that a certain component is or is not part of a certain device. Functionality matters more, which we describe. Similarly, although some items are depicted in the singular form, plural items are contemplated as well (e.g., what is shown as one information store might really be multiple information stores distributed across multiple locations). But showing every variation of each item might obscure the invention. Thus for readability, we show and reference items in the singular (while fully contemplating, where applicable, the plural).

As shown in FIG. 1A, Environment 100 includes listening area 110, which may be a music-listening room, a living room, the interior of an automobile, a movie theater, a showroom, an amphitheater, classroom, or any space where listeners listen to sounds. Environment 100 further includes one or more reflective surfaces 120, which might be a wall, walls, corner, or ceiling of a room, an automobile windshield, or any substantially acoustically-reflective surface. Environment 100 further includes audio information 113, which can include for example analog or digital audio data or one or more audio signals. In one embodiment audio information 113 includes stereophonic information comprising a left-sound component and a right-sound component for producing stereo sound. In one embodiment, audio information 113 includes monophonic information. In this embodiment, a left-sound component and a right-sound component are the same. Audio information 113 may be provided by an audio information source (not shown), which can include for example, a CD player, tuner, television audio signal, audio track for a film or video, microphone, DVD player, digital music player, audio channel(s) of a digital video player, tape machine, record player, or any similar source of audio information. In one embodiment, the audio information is provided as digital information from a computer-readable memory such as a hard disk or solid-state memory.

In one embodiment, environment 100 further includes interface logic 135 that is communicatively coupled to audio information 113. As shown in FIG. 1A, lines representing communicative couplings may represent electrical, optical, wired, wireless connections or any communicative means. Thus, for example audio information 113 may be communicatively coupled to interface logic 135 via a wireless communication, such as audio information received over FM radio waves or via a wireless stream of digital music. Similarly, audio information 113 may be communicatively coupled to interface logic 135 via an electrical connection over a wire or an optical connection over a fiber, for example. Interface logic is also communicatively coupled to a computing device 125, sound sources 150, and electro-acoustic sensor 165. In one embodiment, interface logic 135 includes components necessary for communicating information received from audio information 113 and electro-acoustic sensor 165 to computing device 125 or provided by 125, and for communicating information from computing device 125 to sound sources 150. For example, such components may include convertors, such as analog-to-digital (A/D) converters and digital-to-analog (D/A) converters, amplifiers, transducers, conditioners, buffers, transmitters, and receivers. Thus for example, if audio information 113 comprises information contained in an analog FM radio signal, interface logic 135 may include an antenna, one or more amplifiers, an A/D converter, and other components to provide computing device 125 with audio information 113 in a format usable by computing device 125.

FIG. 1A further illustrates a computing device 125 that is communicatively coupled to information store 140, and interface logic 135. Computing device 125 processes audio information 113, information received from electro-acoustic sensor 165, and model acoustic response information 148, to determine audio-channel compensation information 142 and ultimately to produce audio channels (not shown). Computing device 125 includes one or more processors operable to receive instructions 144 from information store 140, and process them accordingly, and may be embodied as a single computing device or multiple computing devices communicatively coupled to each other. In one embodiment processing actions performed by computing device 125 are distributed among multiple locations such as a local client and one or more remote servers. By way of example, in one embodiment more than one acoustic spatial projector is used to provide sound to a common listening area (for example, see FIG. 3). In this embodiment, each acoustic spatial projector has an associated computing device 125, and processing actions may be distributed across both computing devices 125. For example, the first computing device 125 may perform processing related to rear-surround sound and the second computing device 125 may perform processing related to the front-surround sound and may further direct the processing of the first computing device 125. In one embodiment, computing device 125 is a computer, such as a desktop computer, laptop, tablet computer, or portable digital music player. Example embodiments of computing device 125 include a desktop computer, a cloud-computer or distributed computing architecture, a portable computing device such as a laptop, tablet, ultra-mobile P.C., iPod™, mobile phone, a navigational device, or dashboard-computer mounted in a vehicle. In one embodiment, computing device 125 is one or more microcontrollers or processors. In one embodiment, part or all of interface logic 135 is included in computing device 125. For example, computing device 125 may be a digital-signal processor with built-in A/D and D/A functionality, such as the Freescale Symphony™ 56371 manufactured by Freescale Semiconductor Inc. of Austin, Tex.

Computing device 125 is communicatively coupled to information store 140 that stores instructions 144 for computing device 125, audio-channel compensation information 142, delay output information 146, and model acoustic response information 148. In some embodiments, information store 140 comprises networked storage or distributed storage including storage on servers located in the cloud. Thus, it is contemplated that for some embodiments, the information stored in information store 140 is not stored in the same physical location. For example, in one embodiment, instructions 144 are stored in computing device 125, for example in ROM. In one embodiment, one part of information store 140 includes one or more USB thumb drives, storage on a digital music player or mobile phone, or similar portable data storage media. Additionally, information stored in information store 140 can be searched, queried, analyzed, and updated using computing device 125.

In one embodiment, audio-channel compensation information 142 includes information associated with a given audio channel. For example, in one embodiment compensation information 142 includes parameters for an amount of delay in time, such as "10 ms delay" that is applied to a given channel. Compensation information 142 can further include parameters relating to frequency compensation applied to a given channel. For example, such parameters may specify that frequency bands within a given channel, such as a channel associated with the left-back sound source (which is referred to herein as the "left-back audio channel" or "left-back channel") are to be attenuated, boosted, or delayed by a certain amount in time. Audio channel compensation information is determined by computing device 125, based at least in part on information received via electro-acoustic sensor 165 and model acoustic response information 148, user preferences, or factory-settings, or a combination of all three of these.

Instructions 144 include computer-executable instructions that when executed, facilitate a method for ultimately producing an acoustic field according to embodiments of the present invention. Delay output information 146 includes audio channel information that is delayed before being outputted, ultimately, to sound sources 150. Thus, in some embodiments, delay output information 146 is a buffer. For example, where the center-back audio channel is delayed by 30 ms, delay output information 146 includes information corresponding to a 30 ms delay of the center-back audio channel. Model acoustic response information 148 includes information associated with each audio channel specifying an ideal or desired acoustical response when a sound source associated with the audio channel emits sound waves in an ideal listening environment. In one embodiment, model acoustic response information 148 is determined, and subsequently stored in information store 140, by first sequentially providing a signal having predefined characteristics of frequency, amplitude, and duration to each sound source associated with an audio channel, wherein the sound sources are situated in an ideal listening environment, and optimally directionally positioned with respect to a reflecting surface so as to produce an acoustic field by mixing, on the reflective surface, sounds associated with the audio channels. For example, using FIG. 5 as an illustrative aid, in one embodiment an acoustic spatial projector having a single enclosure enclosing four sound sources, associated with a left-back, center-back, right-back, and center-front channels respectively, is positioned in a listening room such that the center-back sound source is directly pointing at an acoustically reflecting surface, at a location that is centered with respect to the horizontal width of the wall of the room, and is a given distance in front of the wall. The provided signal, which in one embodiment is a pulse, results in sound waves emitted from the sound source, having predefined characteristics of frequency, amplitude, and duration. The sound waves react acoustically with the ideal listening environment resulting in an ideal or desired acoustic response. Next the acoustic response is received by one or more electro-acoustic sensors 165, which may comprise a microphone or set of microphones arranged to directionally receive acoustic information. Information corresponding to the received acoustic response is communicated to computing device 125 via interface logic 135, which processes the acoustic response information for each channel to create a model acoustic response. Finally, in one embodiment, four distinct signals are provided to each sound source simultaneously and an acoustic response is received and processed into model acoustic response information 148. Accordingly, in one embodiment, information in model acoustic response information 148 includes information relating to amplitude, timing, frequency response, and phase response of the received acoustic response corresponding to the signal provided to the sound source associated with each channel, and of the cumulative received acoustic response corresponding to the four distinct signals provided to all four sound sources. In one embodiment, information representing an ideal or desired acoustic response is loaded into model acoustic response 148, based on computer-modeled acoustic responses for different listening environments. In one embodiment, model acoustic response information 148 is adjustable or updateable by a user.

Continuing with FIG. 1A, environment 100 further includes electro-acoustic sensor 165 that is communicatively coupled to interface logic 135, and which may be used to receive acoustic response information, in one embodiment. Environment 100 further includes sound sources 150 that are communicatively coupled to interface logic 135, and which comprise a set of directionally related sound sources. Sound sources 150 receive audio channels (not shown) from computing device 125 by way of logic interface 135. In one embodiment, each received audio channel corresponds to a sound source. In one embodiment sound sources 150 includes a left-back, center-back, and right-back sound source associated with a left-back, center-back, and right-back audio channel, respectively. In one embodiment, sound sources 150 further includes a center-front sound source associated with a center-front audio channel. In one embodiment, each sound source of sound sources 150 is comprised of one or more electro-acoustic transducers such as loud speakers or other sound-generating devices. Thus for example, a single sound source may comprise a tweeter and a midrange speaker.

FIG. 1B illustrates another aspect of exemplary operating environment 100. FIG. 1B shows additional details of an embodiment of sound sources 150. FIG. 1B also depicts reflective surface 120, which is described above in connection to FIG. 1A, and a listener 111 at a listening location 112. In this embodiment, sound sources 150 comprises four sound sources: a left-back sound source 154, a right-back sound source 156, a center-back sound source 152, and a center-front sound source 158. In the embodiment of FIG. 1B, an enclosure 151 includes three rear-facing sets of full-range sound sources 152, 154, and 156, which comprise an acoustic spatial projector (ASP), with each sound source comprised of one or more electro-acoustic transducers and a front-facing full-range sound source 158. The three rear-facing sound sources 152, 154, and 156, which comprise the ASP, are rear facing, with respect to listening area 110. Left-back and right-back sources 154 and 156 are directionally positioned at angles 171 and 172 to center-back source 152, which is directly facing reflecting surface 120. The absolute value of the angle 171 equals the absolute value of the angle 172, in one embodiment, such that the directions of sources 154 and 156 are symmetrical with respect to the reflecting surface. In one embodiment, the values of angles 171 and 172 are determined based in part on the distance of sound sources 152 from reflecting surface 120, such that the absolute values of angles 171 and 172 decrease as this distance increases. In one embodiment, values of angles 171 and 172 are also based on the listening-area environment. In one embodiment, values of angles 171 and 172 are based on user-preferences. In one embodiment, angle 171 is minus 30-degrees and angle 172 is positive 30 degrees with respect to the direction of center-back sound source 152. In one embodiment, values of angles 171 and 172 are adjustable. For example computing device 125 may control a motor to automatically position the left-back and right-back sound sources at angles 171 and 172, respectively. In one embodiment, a front-facing sound source, also referred to as the center-front sound source, is directionally positioned to face the listening area.

Continuing with FIG. 1B, the embodiment shown of enclosure 151 includes chambers 157 each containing one of the sound sources 152, 154, 156, and 158. In another embodiment (shown in FIG. 2), sound sources 152, 154, 156, and 158 are housed in a single chamber (shown as enclosure 257 in FIG. 2).

Figure 2:
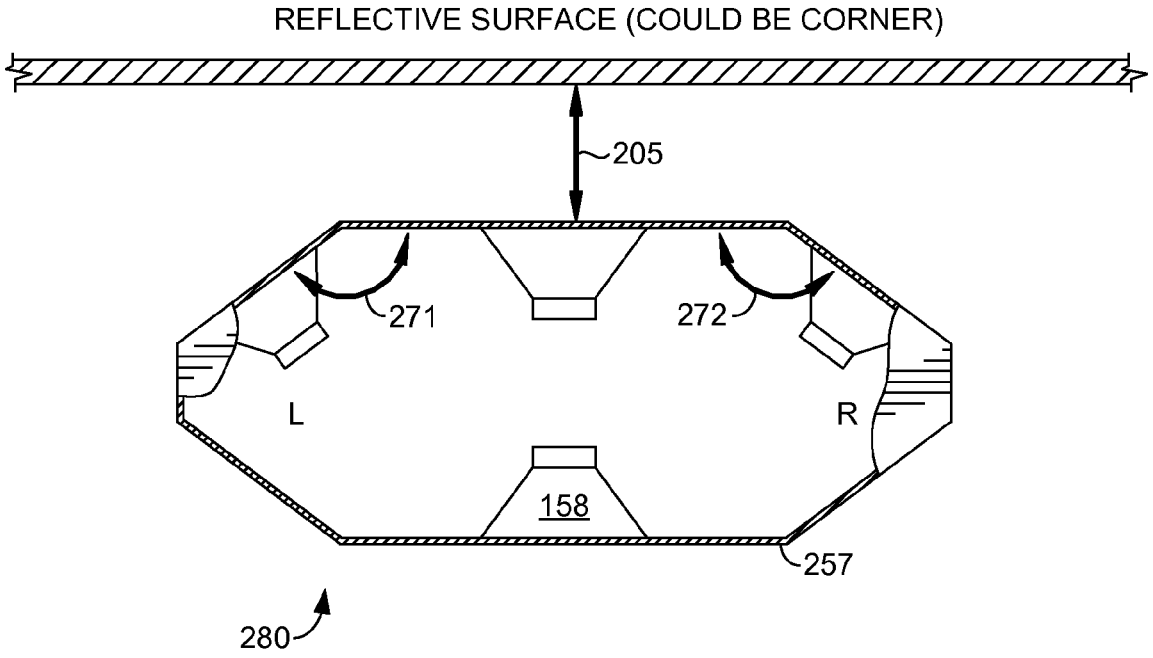
FIG. 2 illustratively depicts aspects of an acoustic spatial projector (ASP) 280 in accordance with an embodiment of our technology.

Turning now to FIG. 2, an illustrative depiction of an acoustic spatial projector (ASP) 280 is provided, from a top-down perspective. In the embodiment shown in FIG. 2, ASP 280 comprises three rear-facing sound sources: left-back sound source 154, center-back sound source 152, and right-back sound source 156, and a front-facing sound source 158. ASP 280 further comprises computing device 125, interface logic 135, and information store 140. In one embodiment, ASP 280 further comprises electro-acoustic sensor 165. For clarity, these components of ASP 280 are omitted. In one embodiment, ASP 280 does not include the front-facing sound source. Left-back and right-back sources 154 and 156 are directionally positioned at angles 271 and 272 to center-back source 152, which is directly facing reflecting surface 120. Also shown in FIG. 2 is distance 205, which is the distance between reflective surface 120 and center-back sound source 152, which in one embodiment is flush with the rear face of enclosure 257. Angles 271 and 272 are similar to angles 171 and 172 described above in connection to FIG. 1B, but in this instance are measured with respect to the perpendicular of the direction of the center-back channel. In one embodiment, angles 271 and 272 are variable and increase as distance 205 decreases. In one embodiment, angles 271 and 272 increase from 20 degrees to 90 degrees, at a nominal 30 degrees for 1 foot of distance.

Figure 3:
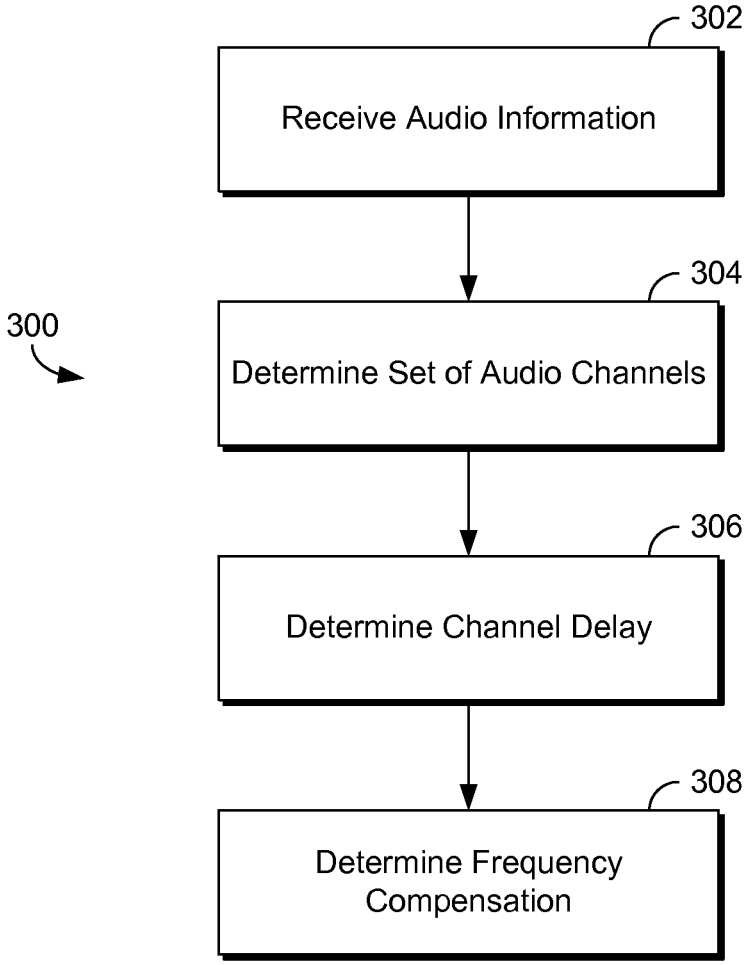
FIG. 3 depicts a method by which the present invention may be used in order to create audio channels for producing an acoustic field.

In FIG. 3, a flow diagram is provided illustrating an exemplary method according to one embodiment, shown as 300. The method of flow diagram 300 is suitable for operation in the exemplary operating environment of FIGS. 1A and 1B. At step 302, audio information is received. The audio information may be received from an audio information source such as, for example, a CD player, tuner, television audio signal, audio track for a film or video, microphone, DVD player, digital music player, audio channel(s) of a digital video player, tape machine, recordplayer, or any similar source of audio information. In one embodiment, the audio information is received as digital information from a computer-readable memory such as a hard disk or solid-state memory. Furthermore, the audio information may be received over a wireless or wired connection, in analog or digital format. The audio information may be processed in near-real time, or stored for subsequent processing.

At a step 304, based on the received audio information, a set of audio channels is determined comprising at least a left-back channel, a center-back channel, and a right-back channel. In one embodiment, a center-front channel is also determined. Each determined audio channel is associated with a sound source. Accordingly, the left-back channel is associated with a left-back sound source, such as source 154 in FIG. 2, a center-back channel is associated with a center-back sound source, such as source 152 in FIG. 2, and a right-back channel is associated with a right-back sound source, such as source 156 in FIG. 2. In an embodiment having a center-front channel, the center-front channel is associated with a center-front sound source such as source 158 in FIG. 2.

In one embodiment, the set of audio channels is determined based on the stereo or mono components of the received audio information. For example, in one embodiment, the received audio information includes a left component ("L") and a right component ("R"), and the set of audio channels is determined such that each audio channel includes a combination of the left and right components. In one embodiment, the left-back channel is determined to be a difference between the left component, multiplied by a predefined factor, and the right component; the right-back channel is determined to be the difference between the right component, multiplied by a predefined factor, and the left component; and the center-back channel is determined to be a combination of the left component and right component. In one embodiment, the predefined factor for the left-back channel is 2 and the predefined factor for the right-back channel is 2. Therefore, the left-back channel is determined to be 2L−R; the right-back channel is determined to be 2R−L. In one embodiment, the center-back channel is determined to be L+R. In one embodiment, the center-back channel is determined to be L+R multiplied by another predefined factor. In embodiments, the predefined factors may be set or adjusted by the listener, determined in advance, or determined by using acoustic response information about the listening environment.

Figure 4A:
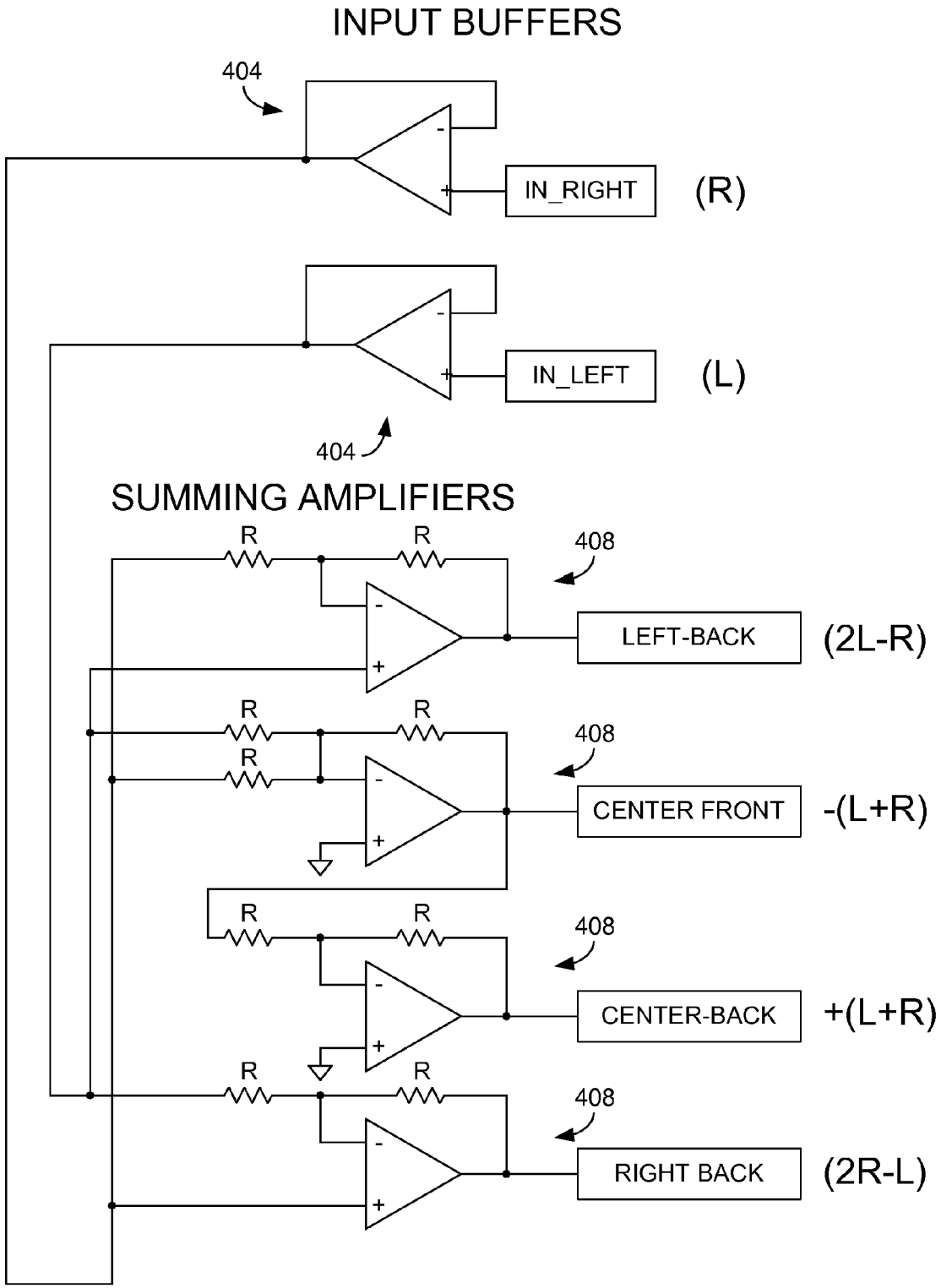
FIG. 4A depicts an aspect of one embodiment that includes an example for determining combinations of L and R components of received audio information for audio channels.

In embodiments having a center-front channel, the center-front channel may be determined to be L+R or −(L+R), depending on the configuration of the center-front sound source 158. For example, in an embodiment where the center-front sound source and the center-back sound source are configured as di-poles, the center-front channel is determined to be L+R; where the configuration is a bi-pole, the center-front channel is the inverse of the center-back channel, thus the center-front channel is determined to be −(L+R). FIG. 4A illustratively depicts one embodiment for determining this configuration of combinations of L and R for the set audio channels, using input buffers 404 and summing amplifiers 408. In one embodiment, computing device 125 determines the set of audio channels from the received audio information. In embodiments where the received audio information is monophonic, L and R components are identical, and combinations of the identical L and R components may be determined in the same manner as previously described. In embodiments where the received audio information includes digital encoding, computing device 125 may determine the audio channels based on the encoded information.

Figure 4B:
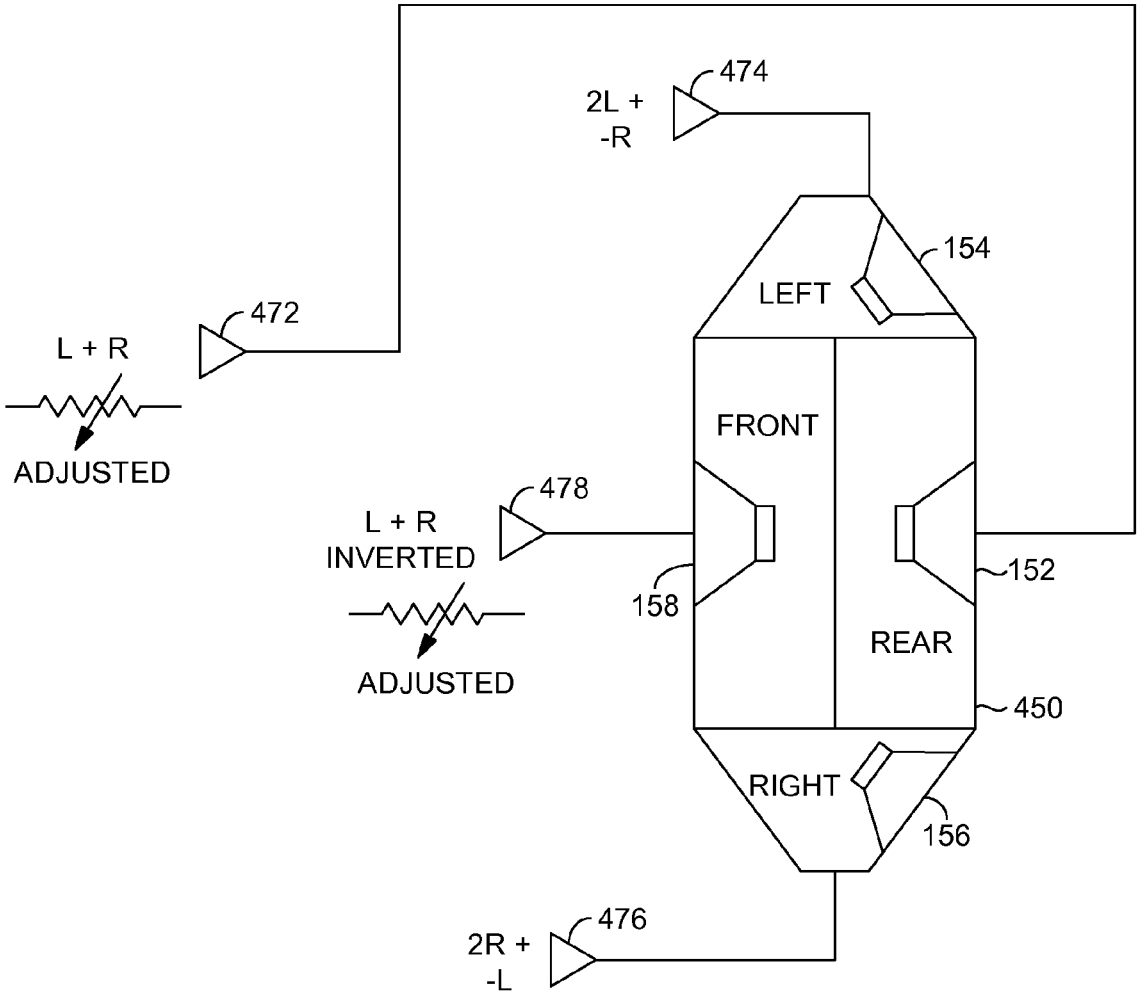
FIG. 4B depicts an aspect of one embodiment showing audio channels provided to sound sources.

FIG. 4B illustratively depicts an embodiment that includes sound sources 450 receiving a set of four audio channels: center-front audio channel 478, center-back audio channel 472, left-back audio channel 474, and right-back audio channel 476, each associated with center-front sound source 158, center-back sound source 152, left-back sound source 154, and right-back sound source 156, respectively. In the embodiment of FIG. 4B, the component combinations of the received audio information are also shown adjacent to each of the audio channels.

Turning back to FIG. 3, at a step 306 a delay is determined and applied to an audio channel in the set of determined audio channels. The delay is determined based on an estimation of time necessary for sound waves emitted by a sound source associated with another audio channel to reach a listening location. For example, in one embodiment a delay is determined and applied to the center-back channel so that sound emitted from the left-back and right-back sound sources, associated with the left-back and right-back channels, respectively, reaches a listening location at a certain time with respect to sound emitted from the center-back sound source, which is associated with the delayed center-back channel. In one embodiment, the delay is determined such that sounds emitted from the sound sources reach a listening location at substantially the same time. Similarly, in embodiments having a center-front channel, a second delay may be determined and applied to the center-front channel such that sound emitted from the center-front sound source reaches a listening location at a certain time with respect to sound emitted from the other sound sources.

Figure 5:
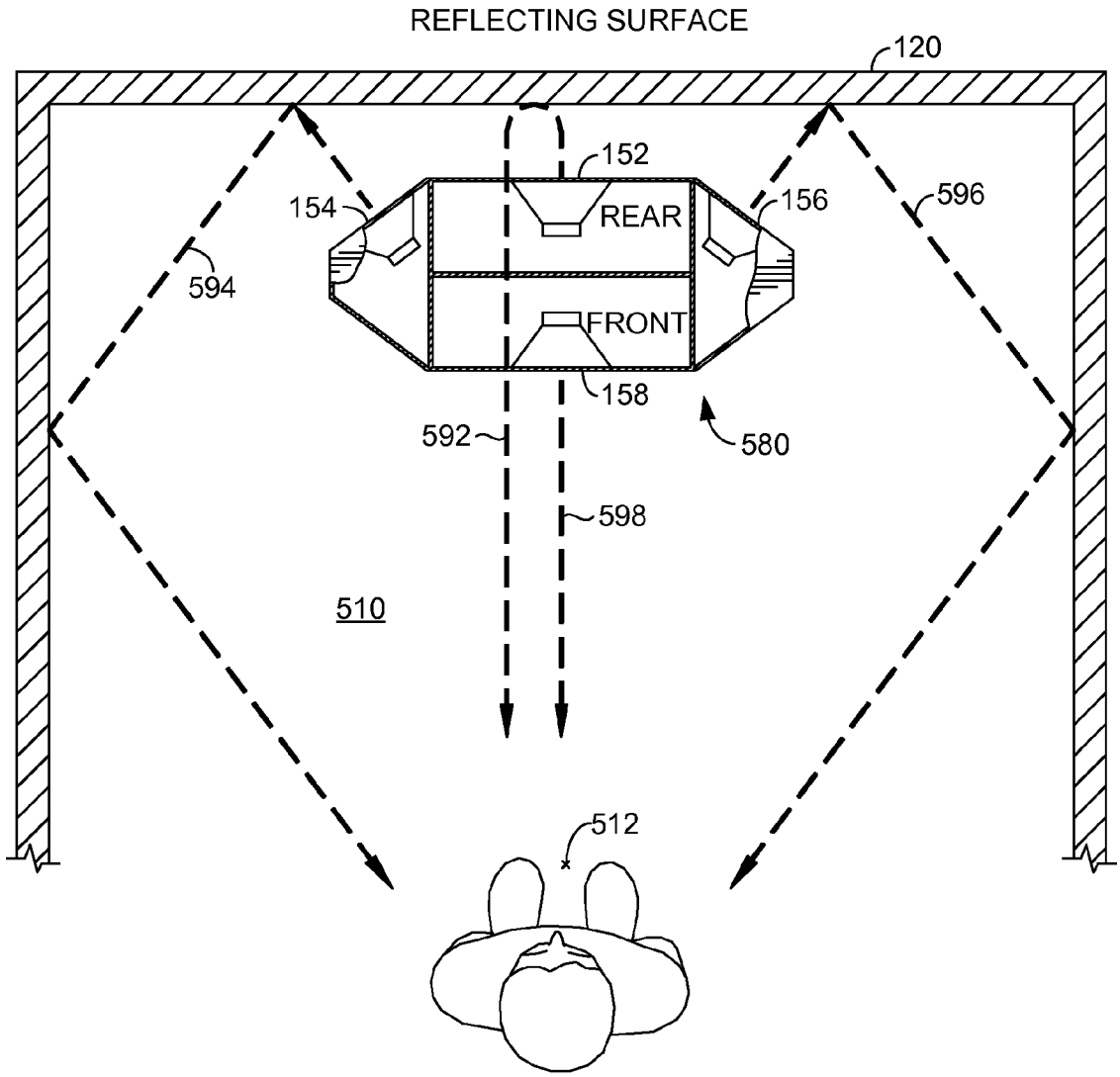
FIG. 5 depicts an aspect of an embodiment for determining and applying a delay to an audio channel.

FIG. 5 illustratively provides an example of how audio-channel delays may be determined and applied. FIG. 5 shows an ASP 580 positioned in a listening area 510 and near an acoustically reflective surface 120. ASP 580 has four sound sources 152, 154, 156, and 158, corresponding to four audio channels (not shown): center-front audio channel, center-back audio channel, left-back audio channel, and right-back audio channel. Additionally, four time-bases, 592, 594, 596, and 598, are depicted in FIG. 5. Each time base is associated with a sound source, and represents an estimated duration of time for sound to travel from each sound source to a listening location 512. Time-base 598 is shorter than time-base 594 and 596, because the sound, emitted from sound source 158, travels a shorter distance to reach location 512 than sound emitted from sound source 154 or 156. Accordingly and by way of example, a delay can be determined and applied to an audio channel, such as the audio channel corresponding to sound source 158, such that the combination of the delay and time-base 598 approximately equals a time-base corresponding to another channel, such as 594, in one embodiment. Similarly, a delay may be determined and applied so that the time bases result in sound waves, corresponding to the same audio event reaching location 512 at different times. For example, in some embodiments it may be desired to delay the center-back channel so that sound waves, corresponding to the same audio event, emitted from the center-back sound source reach location 512 at a later time as sound waves corresponding to the same audio event emitted from the other sound sources. In one embodiment the delay varies from 10 ms to 30 ms. In one embodiment, this delay is automatically determined using a computing device and acoustic response information received by an electro-acoustic sensor. In one embodiment, this delay is adjustable by the listener. In one embodiment, this delay is predetermined.

Turning back to FIG. 3, at a step 308 a frequency compensation is determined and applied to an audio channel in the set of determined audio channels. In one embodiment, the frequency compensation is determined and applied to a range of frequencies or band, which may be narrow or wide, and may also include multiple bands. In embodiments, the frequency compensation may further include varying the amplitude of certain frequencies or imparting a delay in time of certain frequencies. In one embodiment, the frequency compensation is based on acoustical properties of the listening environment. For example, if the reflective surface is a wall that has curtains covering part of it that would otherwise affect certain frequencies, such attenuating certain frequencies, then these frequencies can be boosted to compensate. In one embodiment, the frequency compensation is determined based on a model acoustic response such as, for example, the acoustic response of an ideal listening environment. In one embodiment, a signal having predefined characteristics of frequency, amplitude, and duration is provided to each audio channel that results in a sound emitted from the sound source associated with that audio channel. When this sound is emitted in a listening environment it produces an acoustic response based in part on characteristics of the listening environment and is referred to herein as an impulse response. In one embodiment, a set of distinct and predefined signals are then provided to the audio channel simultaneously, such that each audio channel is provided a distinct predefined signal, and resulting in distinct sounds emitting from the each sound source, simultaneously. When these sounds are emitted in the listening environment, a cumulative acoustic response is produced, based in part on characteristics of the listening environment and is referred to herein as a cumulative impulse response. Acoustic-response information about the listening environment is received. In one embodiment, the acoustic-response information is received by way of one or more electro-acoustic sensors, such as sensor 165 in FIG. 1A. The received acoustic-response information includes, information about amplitude, timing, frequency response, and phase responses. Next a comparison is performed comparing the received acoustic-response corresponding to each audio channel against a model acoustic response for that channel. Based on this comparison, parameters are determined to apply to the audio channel so that its acoustic response in the listening environment more closely matches the acoustic response of the model. These parameters include the frequency compensation discussed previously. For example, one parameter may specify to attenuate the left-back audio channel over a certain set of frequencies. Another parameter may specify to delay in time a certain range of frequencies of the center-back channel, for example. In one embodiment, a comparison is also performed comparing the cumulative received acoustic response (i.e., the acoustic response resulting when distinct sounds are emitted from each sound source simultaneously) and the model acoustic response. Based on this comparison, parameters are further determined and applied to the audio channels so that the cumulative acoustic response in the listening environment more closely matches a cumulative acoustic response of the model.

By way of example, suppose after conducting an impulse response in the new room, it is determined that the sound reflected off the wall is more delayed than what is expected by the model. Accordingly, any existing delay already applied, in step 306 might be shortened so that the actual delay matches the delay in the acoustic response model. Similarly, if it is determined that the received acoustic response has less amplitude at a certain frequency than the model expects, indicating the reflective surface is different, then that frequency can be boosted to compensate.

Figure 6A:
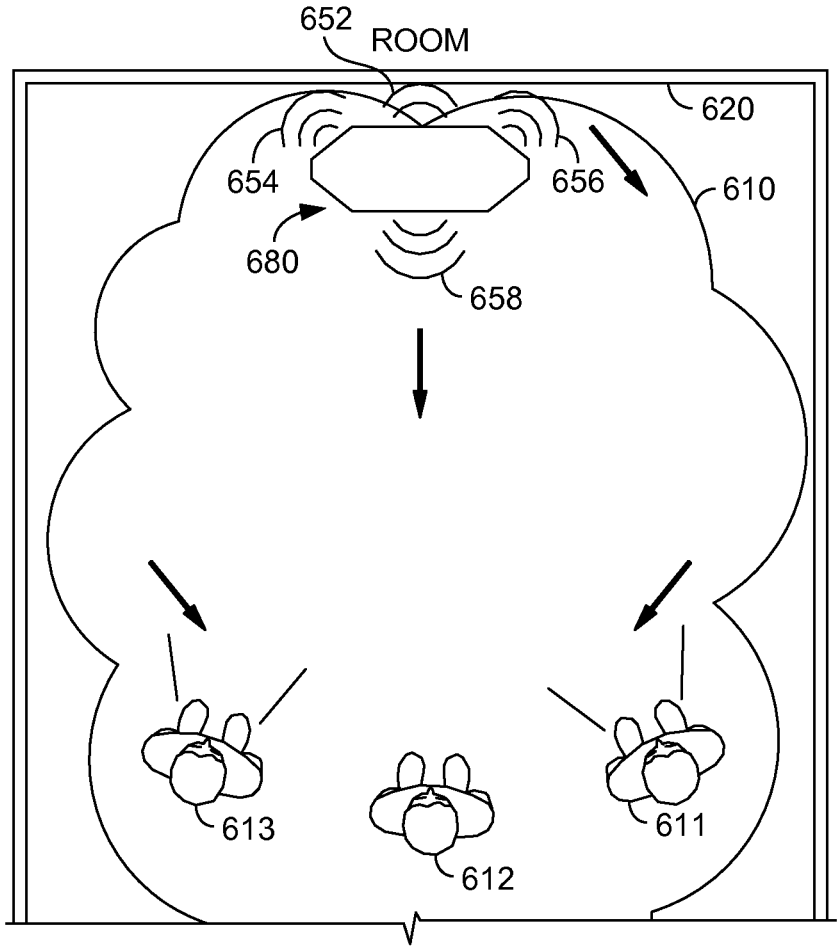
FIG. 6A depicts an embodiment of an acoustic spatial projector.

FIG. 6A illustratively depicts an embodiment of ASP 680, having four sound sources, positioned near reflective surface 620 in listening environment 610. FIG. 6 further depicts three example listening locations 611, 612, and 613. Each sound source of ASP 680, is associated with an audio channel, and is directionally positioned with respect to the other sound sources and reflecting surfaces 620 so as to direct sound onto surface 620 where it can acoustically mix with sounds from the other sound sources and reflect as a coherent wave launch into listening area 610. Specifically, sounds 652, 654, and 656 are emitted from sound sources (not shown) 152, 154, and 156 respectively. Each of these sound sources correspond to an audio channel in a set of audio channels. Sounds 652, 654, and 656 acoustically mix on surface 610 and reflect as an acoustic field into listening area 610. Sound 658 solidifies this acoustic field, for the listener.

In the embodiment where the left-back channel is determined to be the difference of the left component, multiplied by a predefined factor, and the right component, such as 2L−R; the right-back channel is determined to be the difference between the right component, multiplied by a predefined factor, and the left component, such as 2R−L; and the center-back channel is determined to be a combination of the left and right components, such as L+R, the right difference-sound component (i.e., in this example the "−R" in the "2L−R) of sound 654, emitted from the left-back sound source, acoustically combines on the reflective surface with sound 652, emitted from the center-back sound source (which corresponds to an audio channel comprising L+R to create a directionally accurate acoustic image on the left side of the reflective surface. Similarly, the left difference-sound component (i.e., in this example the "L" in the "2R−L) of sound 656, emitted from the right-back sound source acoustically combines on the reflective surface with sound 652, emitted from the center-back sound source (which corresponds to an audio channel comprising L+R to create a directionally accurate acoustic image on the right side of the reflective surface. The acoustic sum of all three reflective-surface-facing sound sources project off the reflective surface to form a coherent, stable, three-dimensional acoustic image and, in the case of recorded audio, projects the entire recorded stage to the room. In one embodiment, a front-facing center-front sound source is used. In this embodiment, the amplitude, frequency response and time displacement of the center-front are adjusted to provide a solidifying presence to the center component of the three-dimensional acoustic image.

Figure 6B:
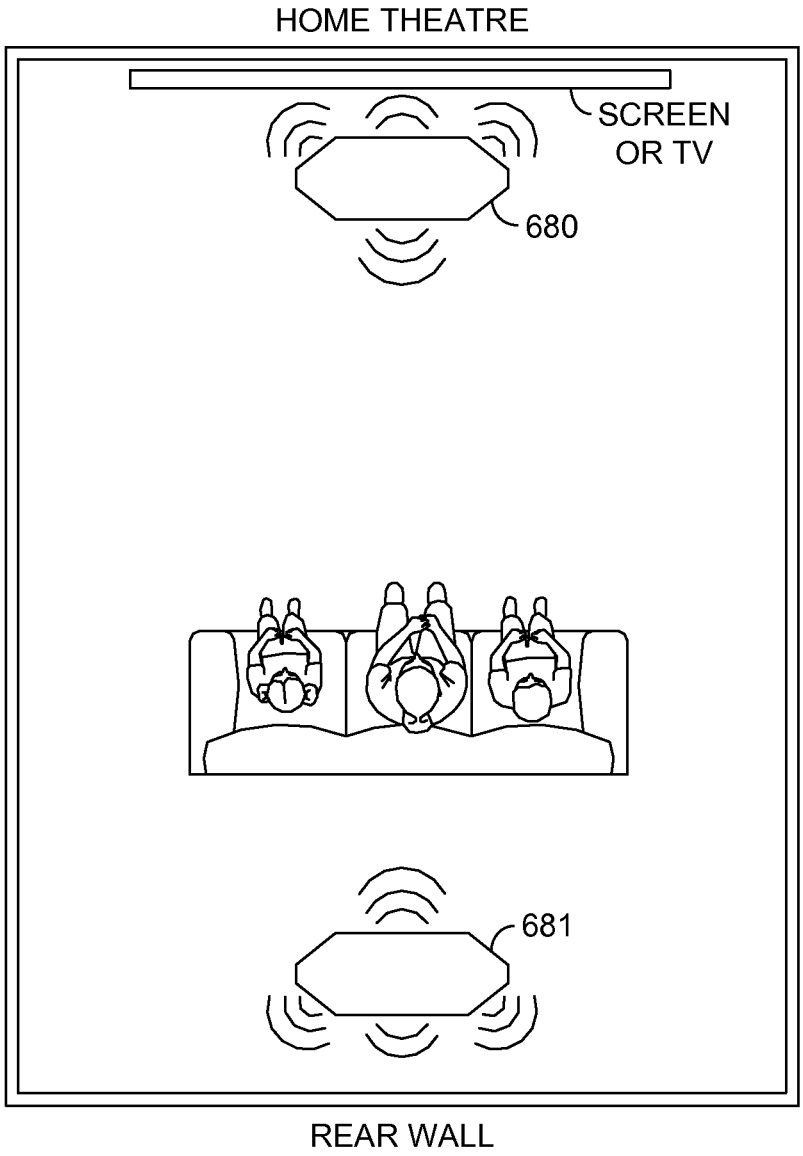
FIG. 6B depicts an illustrative environment suitable for practicing an embodiment of the present invention in a home theatre.

FIG. 6B depicts an illustrative operating environment suitable for practicing an embodiment of the present invention in a home theatre. The embodiment shown in FIG. 6B comprises two ASPs, ASP 680 and ASP 681, which may be configured in a surround-sound configuration. In an embodiment, ASP 680 and 681 are wirelessly communicatively coupled. In one embodiment, the same audio information is provided to ASP 680 and 681. A single computing device controls both ASP 680 and 681, in an embodiment.

Figure 6C:
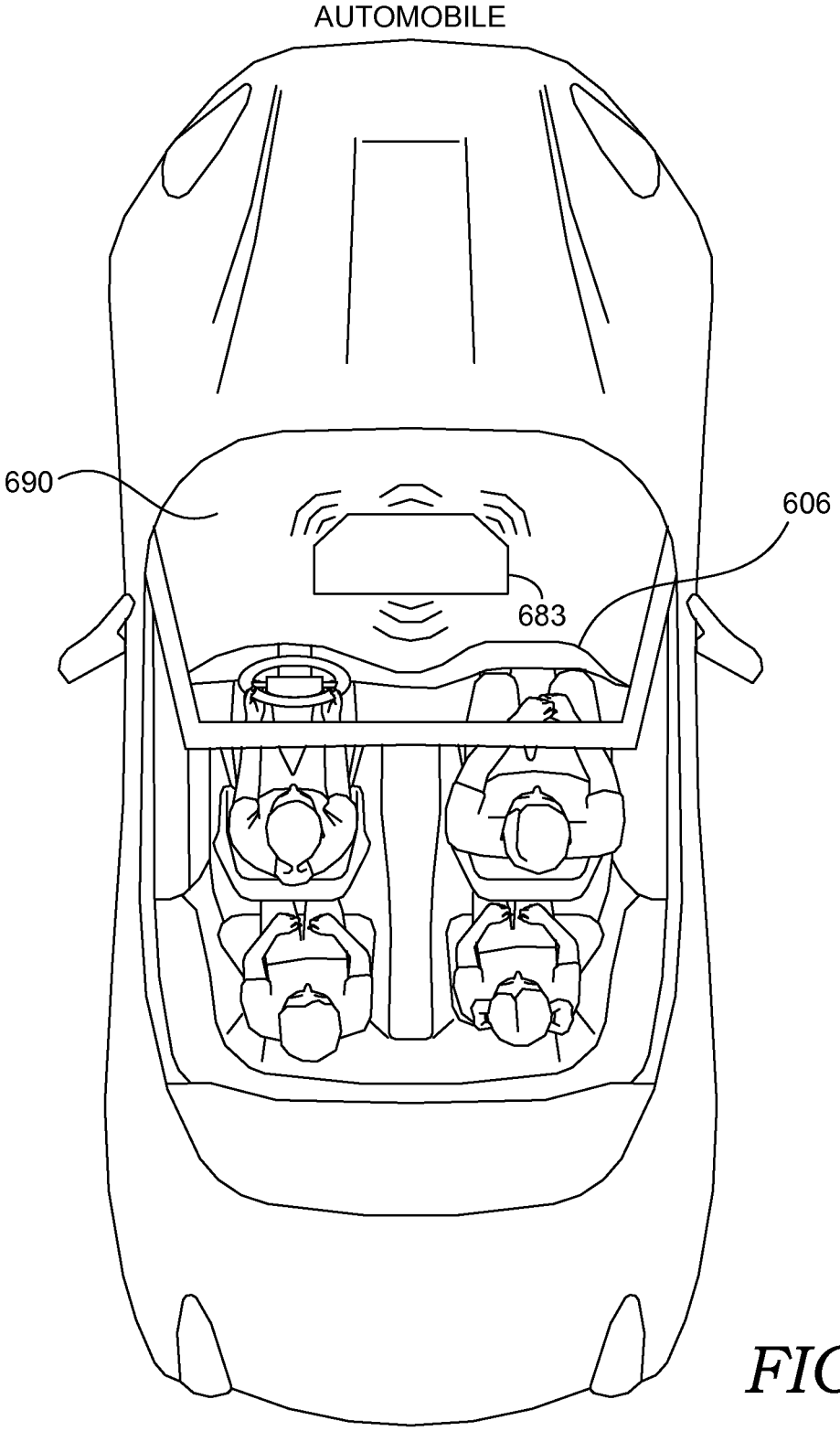
FIG. 6C depicts an illustrative environment suitable for practicing an embodiment of the present invention in a vehicle.

FIG. 6C depicts an illustrative operating environment suitable for practicing an embodiment of the present invention in a vehicle. In the embodiment of FIG. 6C, ASP 683 is positioned near reflective surface 690 which is a front (or rear) windshield of the vehicle. ASP 683 may be mounted to dashboard 606 or embedded within dashboard 606, in an embodiment. In an embodiment (not shown), a second ASP is positioned near the interior of the rear windshield of the vehicle, which functions as an acoustically reflective surface.

Figure 7A:
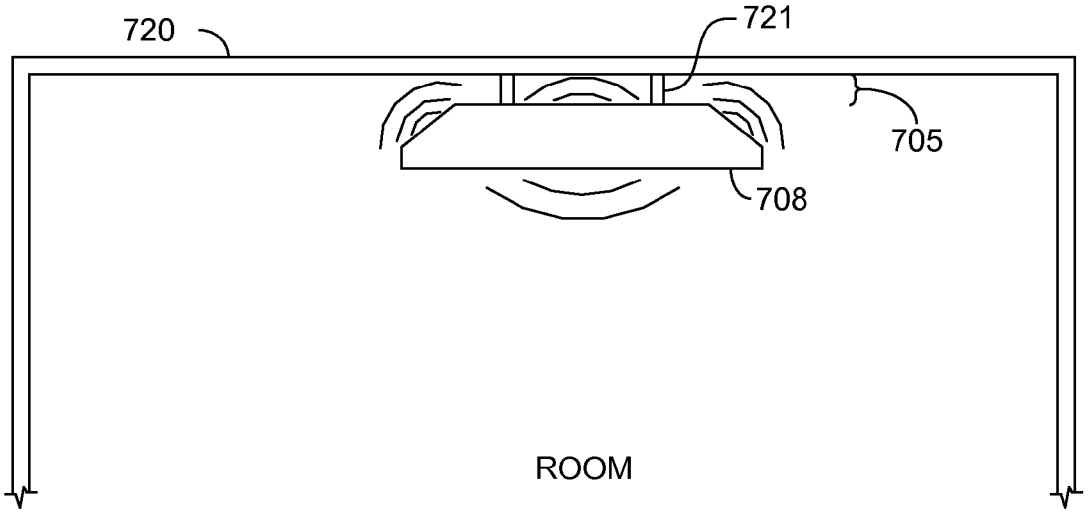
FIGS. 7A-13 depict illustrative environments suitable for practicing embodiments of the present invention.

FIG. 7A depicts an illustrative operating environment suitable for practicing an embodiment of the present invention. In this embodiment, ASP 780 is mounted to reflecting surface 720, which in this embodiment comprises a wall, using one or more anchors 721, which position ASP 780 at a distance 705 from the reflecting surface. In an embodiment, distance 705 corresponds to the angles of the left-back and right-back sound sources in ASP 780. In an embodiment, a delay is predetermined for the center-back and center-front channels, based on distance 705. In one embodiment, ASP 780 is incorporated into a flat-screen television.

Figure 7B:
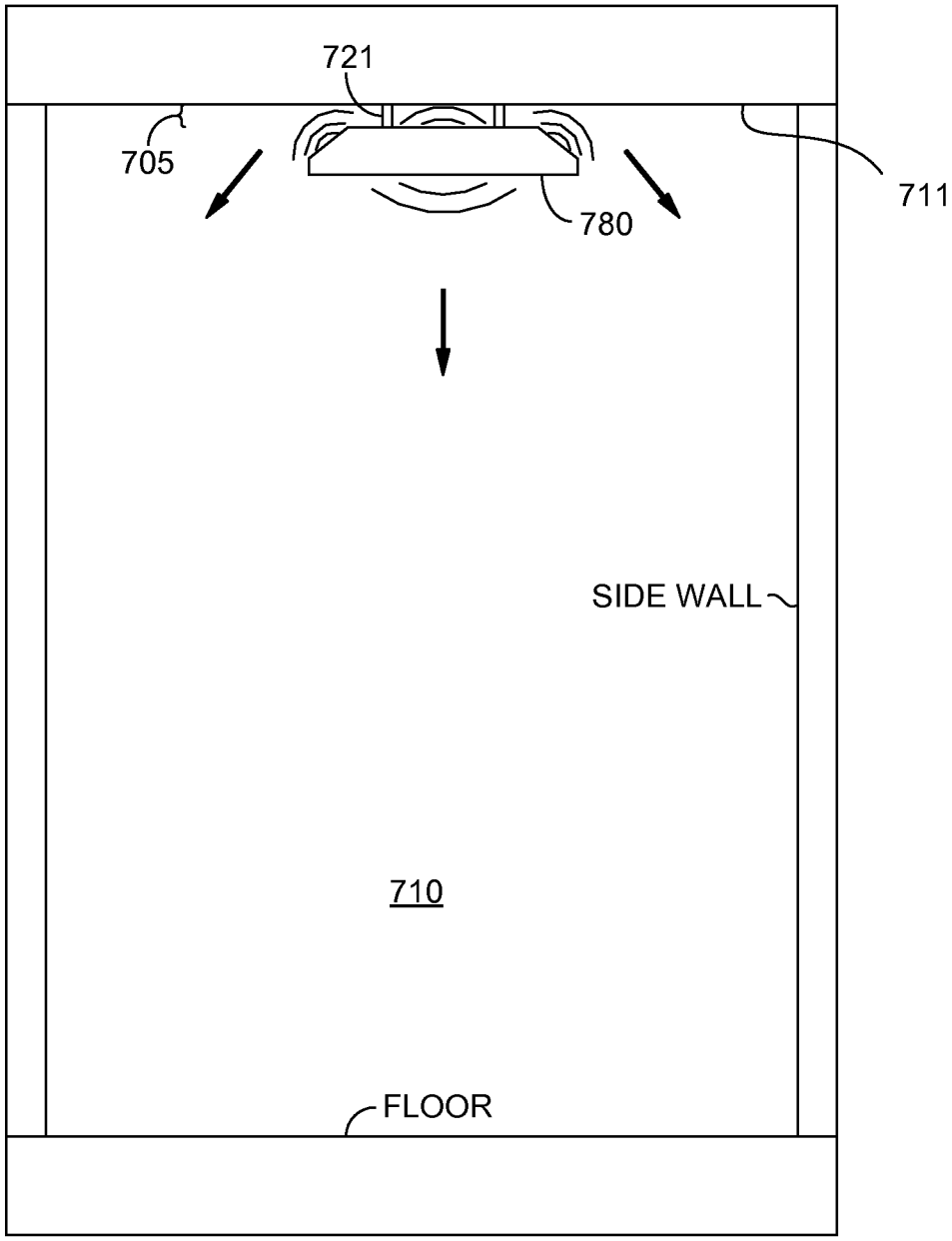

FIG. 7B depicts an illustrative operating environment suitable for practicing an embodiment of the present invention. In this embodiment, the ceiling 711 of listening area 710 functions as a reflecting surface 711, and ASP 780 is mounted to the ceiling using one or more anchors 721, which position ASP 780 at a distance 705 from the reflecting surface.

Figure 8A:
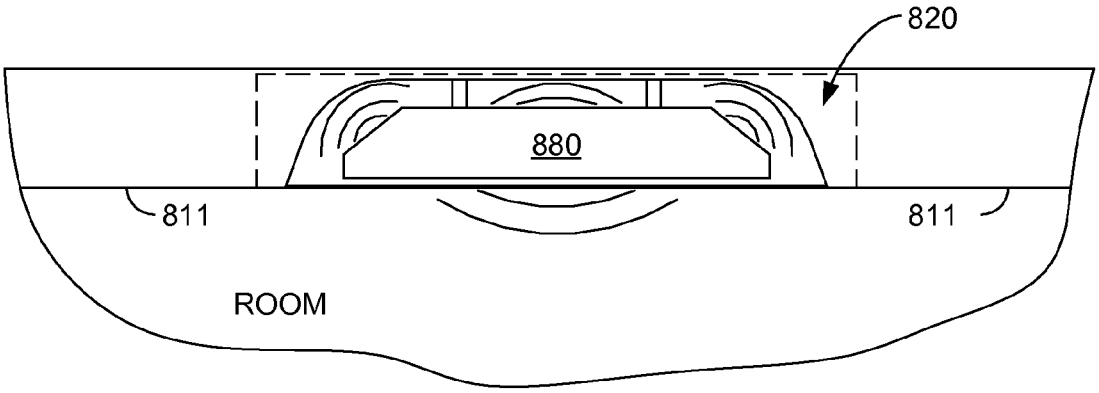
Figure 8B:
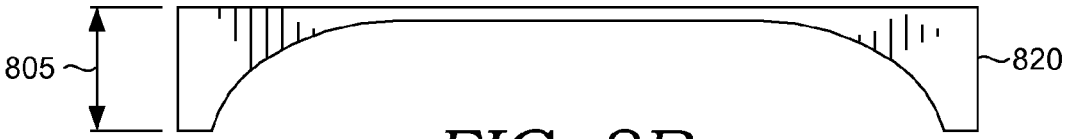
Figure 8C:
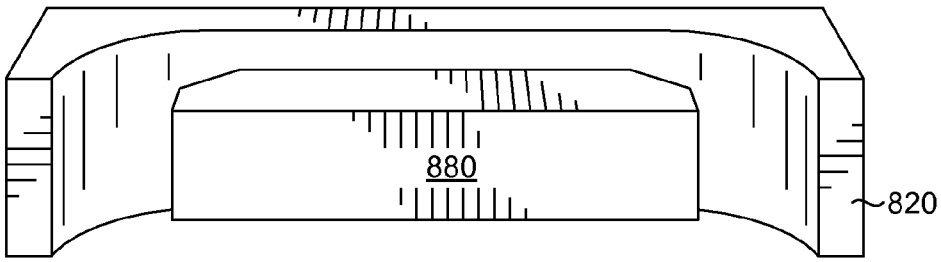

FIGS. 8A-8C depict three different aspects of an illustrative operating environment suitable for practicing an embodiment of the present invention wherein ASP 880 is mounted inside a wall or ceiling 811. In the embodiment shown in FIGS. 8A-8C, reflective surface 820 comprises a wall (or ceiling) insert module. In one embodiment, reflective-surface module 820 is open on top and bottom and curved on the left and right sides for further acoustic reflection. In an embodiment reflective-surface module 820 is formed from a substantially solid material. In an embodiment, the dimensions of reflective-surface module 820 correspond to the thickness of a wall or the distance between studs of a wall, for facilitating installation. For example, in one embodiment, the width of reflective surface module 820 is 3.5 inches, and the length is 30.5 inches (a width corresponding to the total distance between the facing sides of two wall studs (not shown), centered at 16-inches). In one embodiment, a grill cloth 887 covers ASP 880 such that the grill cloth is flush with surface of the wall or ceiling.

Figure 9:
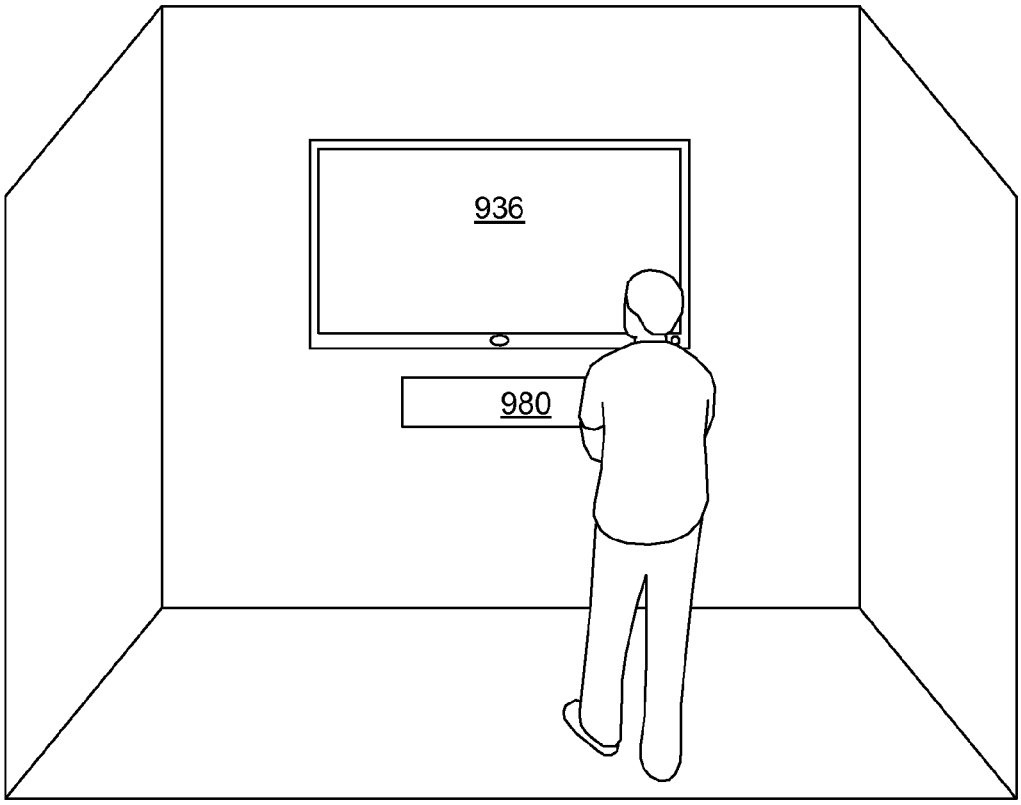

FIG. 9 depicts an illustrative operating environment suitable for practicing an embodiment of the present invention wherein ASP 980 is mounted near a television or theater screen 936. In one embodiment, ASP 980 is mounted in the wall above or below screen 936. In one embodiment, ASP 980 is mounted on the wall above or below screen 936. In one embodiment, ASP 980 includes HDMI and component inputs and further includes surround-sound processing ("SSP") internally.

Figure 10A:
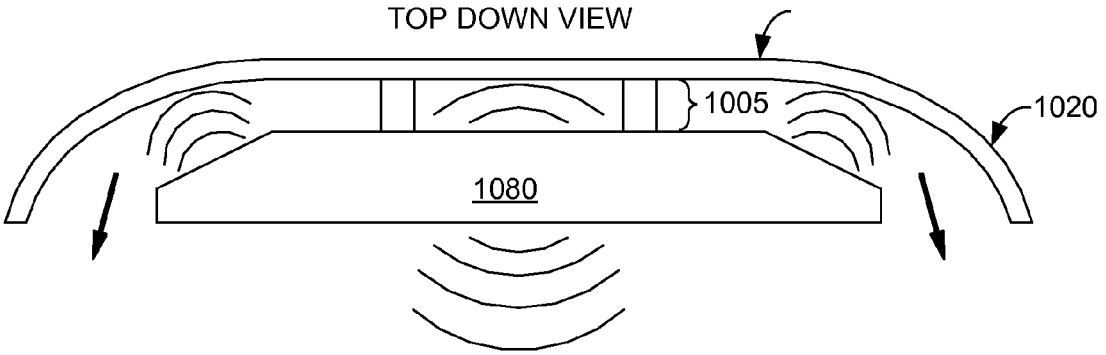
Figure 10B:
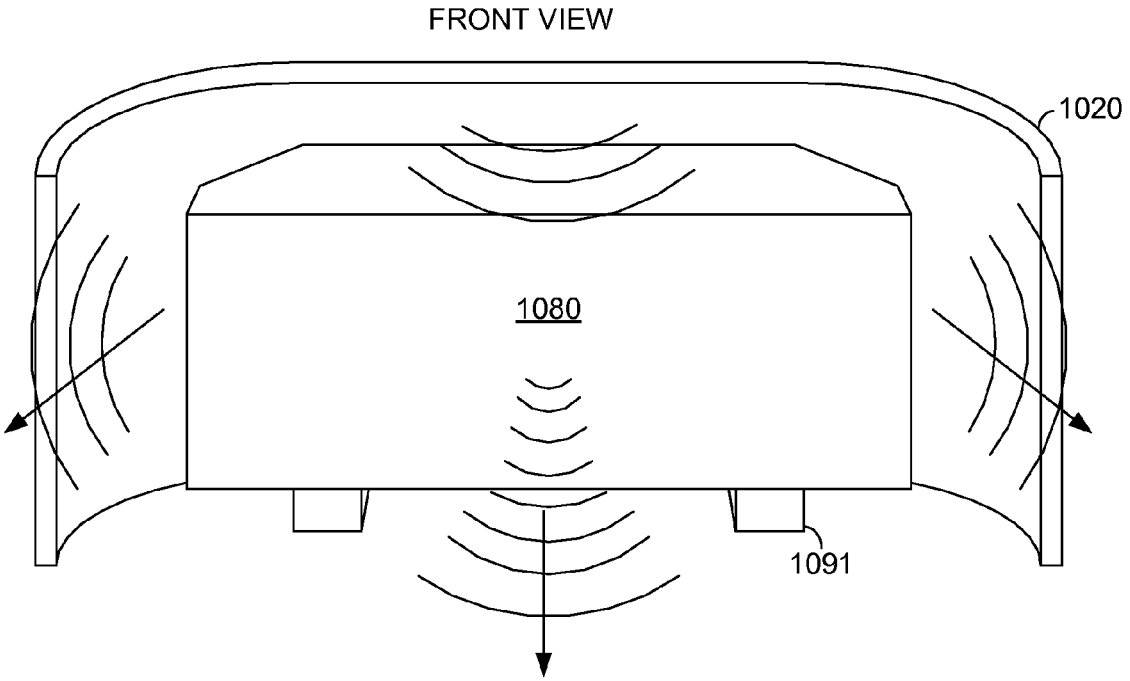

FIGS. 10A and 10B depict two perspectives of an illustrative operating environment suitable for practicing an embodiment of the present invention in a free-standing implementation such as on a desk, table, shelf, countertop, or similar surface. FIG. 10A depicts a top-down perspective, and FIG. 10B depicts a frontal perspective. In this embodiment, reflective surface 1020 is attached to ASP 1080, such that ASP 1080 is positioned at a distance 1005 from reflecting surface 1020. In an embodiment, distance 1005 corresponds to the angles of the left-back and right-back sound sources in ASP 1080. In an embodiment, a delay is pre-determined for the center-back and center-front channels, based on distance 1005. In an embodiment, feet 1091 or a base are used to elevate ASP 1080, thereby allowing a portion of reflected sound to reflect under ASP 1080. In an embodiment, ASP 1080 includes a low-frequency sound source, which is directed out of the bottom of ASP 1080. In this embodiment, the elevation provided by feet 1091 facilitates the production of audible sound pressure from the low-frequency sound source. In one embodiment, reflective-surface module 1020 is open on top and bottom and curved on the left and right sides for further acoustic reflection. In an embodiment, surface 1020 extends below and above ASP 1080. In one embodiment, ASP 1080 includes a USP input for receiving audio information. In one embodiment, ASP 1080 includes an iPod™ dock or similar mobile digital-music player input.

Figure 11:
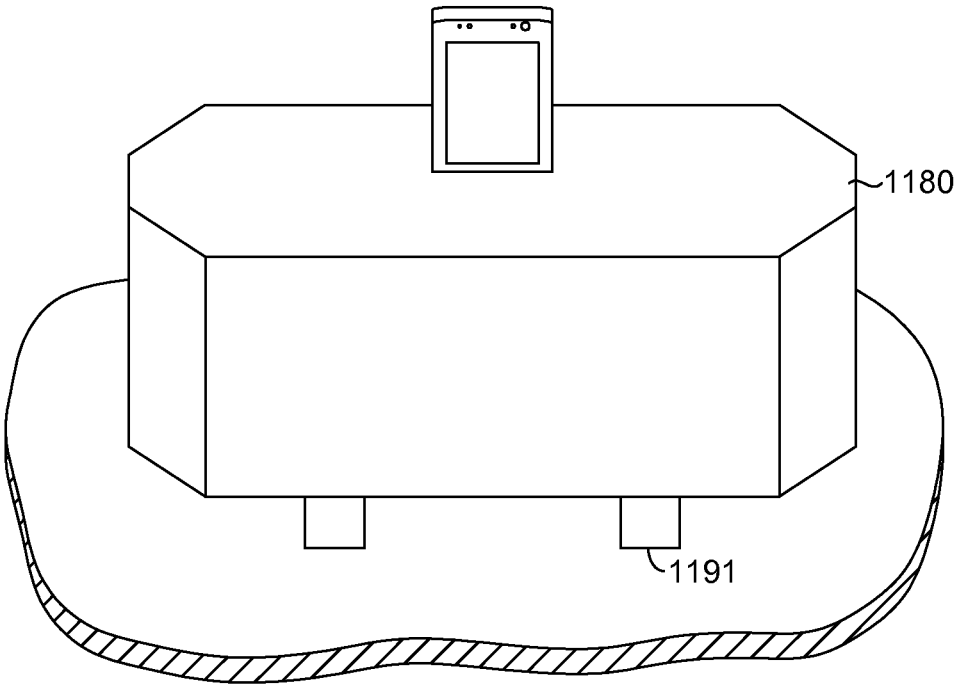

FIG. 11 depicts an illustrative operating environment suitable for practicing an embodiment of the present invention in a free-standing implementation such as on a desk, table, shelf, countertop, or similar surface, where a reflective surface (not shown) such as a wall or interior back of a bookshelf is available. In the embodiment depicted in FIG. 11, ASP 1180 includes feet 1191 or a base, which elevate ASP 1180, thereby allowing a portion of reflected sound to reflect under ASP 1180. ASP 1180 further includes a dock for connecting an iPod™ or mobile digital music player. In one embodiment, ASP 1180 further includes wireless input for receiving streamed music over a network and an AM/FM/DAB tuner for receiving audio over the airwaves.

Figure 12:
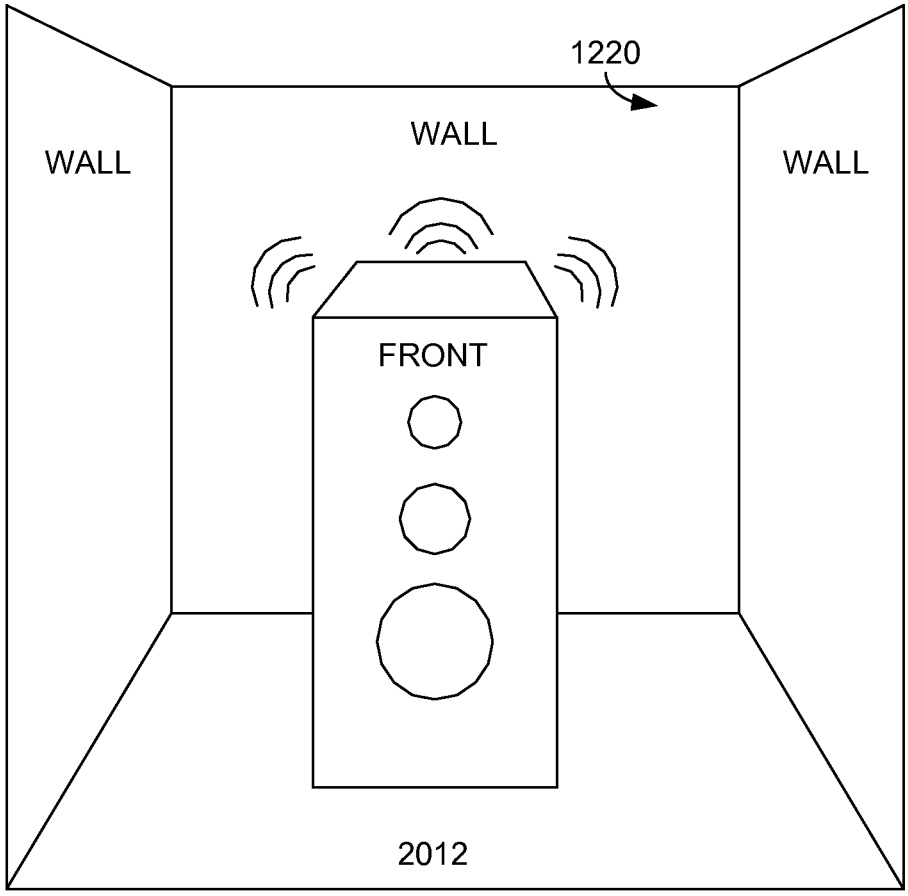

FIG. 12 depicts an illustrative operating environment suitable for practicing an embodiment of the present invention on the floor, wherein ASP 1280 is positioned in front of reflective surface 1220. In one embodiment, ASP 1280 rests on floor 1212. In another embodiment (not shown) ASP 1280 is positioned on a floor stand.

Figure 13:
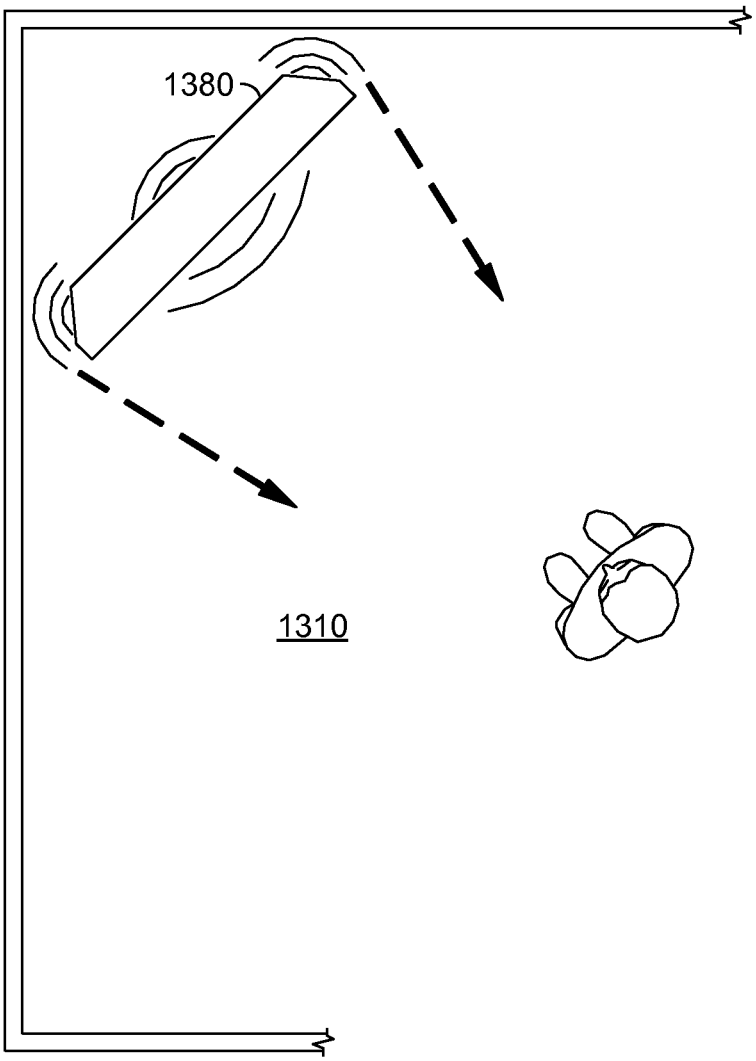

FIG. 13 depicts an illustrative operating environment suitable for practicing an embodiment of the present invention in a corner of a listening area, wherein ASP 1380 is positioned in the corner of listening area 1310. In one embodiment, a second ASP 1380 is positioned in the opposite corner of listening area 1310.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. One or more nontransitory computer-readable media having computer-executable instructions embodied thereon that when executed, facilitate a method for creating audio channels for producing an acoustic field by mixing, on a reflective surface, sounds associated with the audio channels, the method comprising:

(a) using audio information, determining a set of audio channels, wherein each channel is associated with a sound source, and wherein the set of audio channels includes a first subset of channels and a second subset of channels, wherein each audio channel of the first subset of audio channels has an associated sound source that emits sound waves directed at a reflective surface prior to being received at a listening location, wherein one or more of the sound sources associated with the first subset of audio channels is positioned at one or more angles with respect to a first reflective surface, wherein a second reflective surface is positioned horizontally beneath the acoustic spatial projector, and wherein the acoustic spatial projector rests upon one or more supports in contact with the horizontal reflective surface, wherein the one or more supports elevate the acoustic spatial projector at a distance above the reflective surface that allows a portion of reflected sound to reflect under the acoustic spatial projector;

(b) determining a first delay to apply to a first channel of the set of audio channels, wherein the first delay is determined as a function of an estimated duration of time for sound waves emitted by a first sound source associated with the first channel to reach the listening location; and (c) determining a frequency compensation to apply to at least one channel of the second subset of audio channels, wherein the frequency compensation is based on a model acoustic response that includes information relating to at least one of amplitude, timing, phase response, or frequency response.

2. The one or more nontransitory computer-readable media of claim 1 wherein the frequency compensation comprises at least one of:

(i) attenuating or boosting a first range of frequencies of the at least one channel of the second subset of channels, or (ii) applying a frequency-based delay to a second range of frequencies of the at least one channel of the second subset of channels.

3. The one or more nontransitory computer-readable media of claim 1 wherein the first subset of audio channels includes a left channel associated with a left sound source directionally positioned towards the reflective surface at a first angle, a right channel associated with a right sound source directionally positioned towards the reflective surface at a second angle, and a center channel associated with a center sound source.

4. The one or more nontransitory computer-readable media of claim 3 wherein the audio information includes a left-channel component and right-channel component; and wherein the set of audio channels is determined such that the left channel represents a first combination of the left-channel component and the right-channel component, and the right channel represents a second combination of the left-channel component and the right-channel component.

5. The one or more nontransitory computer-readable media of claim 4 wherein the first combination is determined by calculating a difference between the left-channel component, multiplied by a predefined factor, and the right-channel component, and the second combination is determined by calculating a difference between the right-channel component, multiplied by a the predefined factor, and the left-channel component.

6. The one or more nontransitory computer-readable media of claim 3 wherein the method further comprises determining a second delay, wherein the set of audio channels includes a center-front channel associated with a center-front sound source directionally positioned to substantially face the listening area;

wherein the second delay is applied to the center-front channel of the set of audio channels; and wherein the second delay is determined as a function of an estimated duration of time for sound waves emitted by the center-front sound source to reach the listening location.

7. The one or more nontransitory computer-readable media of claim 6 wherein the first and second delays are further determined such that sound waves emitted by each of the left sound source, right sound source, and center-front sound source will reach the listening location at substantially the same time.

8. The one or more nontransitory computer-readable media of claim 1 wherein the method for determining the frequency compensation further comprises:

for the at least one audio channel of the second subset of audio channels:

(i) providing an audio signal having predefined characteristics of frequency, amplitude, or duration, thereby resulting in sound waves being emitted from the at least on audio channel's associated sound source;

(ii) receiving acoustic-response information corresponding to the sound waves;

(iii) comparing the received acoustic-response information to information in the model acoustic response;

(iv) based on the comparison, determining the frequency-compensation for the at least one audio channel; and (v) storing information representing the frequency-compensation for the at least one audio channel.

9. The one or more nontransitory computer-readable media of claim 8 wherein frequency compensation is determined and applied to each audio channel of the second subset of audio channels.

10. The one or more nontransitory computer-readable media of claim 8 wherein determining the frequency compensation further comprises:

(a) Substantially simultaneously providing a distinct audio signal on each channel of the second subset of the set of audio channels, each distinct signal having predefined characteristics of frequency, amplitude, or duration, thereby resulting in an emission of sound waves from each sound source associated with each channel of the second subset of channels;

(b) receiving combined acoustic-response information;

(c) comparing the received combined-acoustic-response information to information in the model acoustic response;

(d) based on the comparison of the received combined acoustic-response information to information in the model and the stored frequency-compensation for the at least one audio channel of the second subset of audio channels, determining an updated frequency-compensation for the at least one audio channel of the second subset of audio channels; and (e) storing information representing the updated frequency-compensation for the at least one audio channel of the second subset of audio channels.

11. The one or more nontransitory computer-readable media of claim 1 wherein the audio information includes information corresponding to volume, and wherein an output volume is determined to apply to one or more audio channels of the set of audio channels, such that the output volume increases nonlinearly with respect to increases in volume of the audio information.

12. A method for creating audio channels for producing an acoustic field by mixing sound waves associated with the audio channels on a reflective surface, the method comprising:

(a) using audio information, determining a set of audio channels, wherein each channel is associated with a sound source included in an acoustic spatial projector, and wherein the set of audio channels includes a first subset of channels and a second subset of channels, wherein each audio channel of the first subset of audio channels has an associated sound source that emits sound waves directed at a reflective surface prior to being received at a listening location, wherein one or more of the sound sources associated with the first subset of audio channels is positioned at one or more angles with respect to another of the sound sources associated with the first subset of audio channels, wherein the reflective surface is mechanically coupled to the acoustic spatial projector and positioned at a distance from the acoustic spatial projector, wherein the reflective surface is open at the top and the bottom and curved on the left and right sides, wherein the reflective surface is positioned behind, and faces a back side of, the acoustic spatial projector, wherein an upper portion of the reflective surface extends vertically higher than the acoustic spatial projector and a lower portion of the reflective surface extends vertically lower than the acoustic spatial projector, and wherein the distance of the reflective surface from the acoustic spatial projector corresponds to the one or more angles of the one or more sound sources;

(b) determining a first delay to apply to a first channel of the set of audio channels, wherein the first delay is determined as a function of an estimated duration of time for sound waves emitted by a first sound source associated with the first channel to reach the listening location; and (c) determining a frequency compensation to apply to at least one channel of the second subset of audio channels, wherein the frequency compensation is based on a model acoustic response that includes information relating to at least one of amplitude, timing, phase response, or frequency response.

13. The method of claim 12 wherein the frequency compensation comprises at least one of:

(i) attenuating or boosting a first range of frequencies of the at least one channel of the second subset of channels, or (ii) applying a frequency-based delay to a second range of frequencies of the at least one channel of the second subset of channels.

14. The method of claim 12 wherein the first subset of audio channels includes a left-back channel associated with a left-back sound source directionally positioned towards the reflective surface at a first angle, a right-back channel associated with a right-back sound source directionally positioned towards the reflective surface at a second angle, and a center-back channel associated with a center-back sound source directionally positioned to substantially face the reflective surface.

15. The method of claim 14 further comprising determining a second delay, wherein the set of audio channels further includes a center-front channel associated with a center-front sound source directionally positioned to substantially face the listening area;

wherein the second delay is applied to the center-front channel of the set of audio channels, and the first delay is applied to the center-back channel of the set of audio channels; and wherein the second delay is determined as a function of an estimated duration of time for sound waves emitted by the center-front sound source to reach the listening location.

16. The method of claim 12 wherein determining the frequency compensation further comprises:

for the at least one audio channel of the second subset of audio channels:

(i) providing an audio signal having predefined characteristics of frequency, amplitude, or duration, thereby resulting in sound waves being emitted from the at least on audio channel's associated sound source;

(ii) receiving acoustic-response information corresponding to the sound waves;

(iii) comparing the received acoustic-response information to information in the model acoustic response;

(iv) based on the comparison, determining the frequency-compensation for the at least one audio channel; and (v) storing information representing the frequency-compensation for the at least one audio channel.

17. The method of claim 16 wherein determining the frequency compensation further comprises:

(a) Substantially simultaneously providing a distinct audio signal on each channel of the second subset of the set of audio channels, each distinct signal having predefined characteristics of frequency, amplitude, or duration, thereby resulting in the emission of sound waves from each sound source associated with each channel of the second subset of channels;

(b) receiving combined acoustic-response information;

(c) comparing the received combined-acoustic-response information to information in the model acoustic response;

(d) based on the comparison of the received combined acoustic-response information to information in the model and the stored frequency-compensation for the at least one audio channel of the second subset of audio channels, determining an updated frequency-compensation for the at least one audio channel of the second subset of audio channels; and (e) storing information representing the updated frequency-compensation for the at least one audio channel of the second subset of audio channels.

18. A system for use in producing a three-dimensional acoustic field by mixing sounds associated with audio channels on a reflective surface, the system comprising:

an enclosure containing at least three sound sources including a left sound source directionally positioned towards a vertical reflective surface at a first angle, a right sound source directionally positioned towards the vertical reflective surface at a second angle, and a center-front sound source directionally positioned toward the listening area, wherein the left sound source and the right sound source emit sound waves directed at the vertical reflective surface prior to being received at a listening location, wherein the vertical reflective surface is positioned behind the enclosure at a distance from the left and right sound sources, wherein the enclosure is supported by a base or feet resting on a horizontal reflective surface beneath the enclosure which elevate the enclosure above the horizontal reflective surface, and wherein sound is directed toward the horizontal reflective surface;

one or more processors that execute instructions for facilitating a method of creating audio channels for producing an acoustic field by mixing sounds associated with the audio channels on the reflective surface, the method comprising:

(1) using audio information, determining a set of audio channels, wherein each channel is associated with a sound source, and wherein the set of audio channels includes a first subset of channels and a second subset of channels, wherein each audio channel of the first subset of audio channels has an associated sound source that emits sound waves directed at the reflective surface prior to being received at a listening location, wherein the audio channels of the first subset of audio channels are respectively associated with the left sound source and the right sound source;

(2) determining a first delay to apply to a first channel of the set of audio channels, wherein the first delay is determined at least in part on the distance of the reflective surface from the enclosure; and (3) determining a frequency compensation to apply to at least one channel of the second subset of audio channels, wherein the frequency compensation is based on a model acoustic response that includes information relating to at least one of amplitude, timing, phase response, or frequency response.

19. The system of claim 18, wherein the first angle of the left sound source and the second angle of the right sound source are adjustable, and wherein a motor is controlled to automatically adjust the first angle and the second angle based at least in part on the distance of the left and right sound sources from the reflective surface.

* * * * *